US008528396B2

(12) United States Patent
Wu et al.

(10) Patent No.: US 8,528,396 B2
(45) Date of Patent: Sep. 10, 2013

(54) PHASE SEPARATION DETECTION IN DOWNHOLE FLUID SAMPLING

(75) Inventors: Xu Wu, Tokyo (JP); Tsutomu Yamate, Yokohama (JP); Toru Terabayashi, Sugar Land, TX (US); Ricardo Vasques, Bailly (FR); Chengli Dong, Sugar Land, TX (US); Peter S. Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 512 days.

(21) Appl. No.: 12/363,835

(22) Filed: Feb. 2, 2009

(65) Prior Publication Data

US 2010/0192684 A1 Aug. 5, 2010

(51) Int. Cl.
*E21B 49/08* (2006.01)

(52) U.S. Cl.
USPC ..... 73/152.55

(58) Field of Classification Search
USPC ..... 73/152.55
See application file for complete search history.

(56) References Cited

U.S. PATENT DOCUMENTS

| | | | | |
|---|---|---|---|---|
| 6,886,406 | B1 * | 5/2005 | Couet et al. | 73/579 |
| 7,461,547 | B2 * | 12/2008 | Terabayashi et al. | 73/152.55 |
| 2004/0168827 | A1 * | 9/2004 | Jeffryes | 175/48 |
| 2006/0243047 | A1 * | 11/2006 | Terabayashi et al. | 73/152.55 |
| 2007/0214877 | A1 * | 9/2007 | Shammai | 73/152.24 |
| 2009/0078036 | A1 * | 3/2009 | Terabayashi et al. | 73/152.55 |

OTHER PUBLICATIONS

Betancourt, Soraya et al., Exploration Applications of Downhole Measurement of Crude Oil Composition and Fluorescence, SPE 87011, Kuala Lumpur, Malaysia, Mar. 29-30, 2004.

Fujisawa, Go et al., Analyzing Reservoir Fluid Composition In-Situ in Real-Time: Case Study in a Carbonate Reservoir, SPE 84092, Denver, Colorado, Oct. 5-8, 2003.

Elshahawi, H. et al., Insitu Characterization of Formation Fluid Samples—Case Studies, SPE 90932, Houston, Texas, Sep. 26-29, 2004.

Fujisawa, Go et al., Hydrocarbon Compositional Gradient Revealed by In-Situ Optical Spectroscopy, SPE 89704, Houston, Texas, Oct. 2, 2007.

Dong, C. et al., New Downhole Fluid Analyzer Tool for Improved Reservoir Characterization, SPE 108566, Aberdeen, Scotland, Sep. 4-7, 2007.

Mullins, Oliver C. et al., Downhole Determination of GOR on Single-Phase Fluids by Optical Spectroscopy, SPWLA 42nd Annual Logging Symposium, Jun. 17-20, 2001.

Mullins, Oliver C. et al., Hydrocarbon Compositional Analysis In-Situ in Openhole Wireline Logging, SPWLA 45th Annual Logging Symposium, Jun. 6-9, 2004.

* cited by examiner

*Primary Examiner* — Hezron E Williams
*Assistant Examiner* — Gregory J Redmann
(74) *Attorney, Agent, or Firm* — John Vereb

(57) ABSTRACT

Example methods and apparatus to detect phase separation in downhole fluid sampling operations are disclosed. An example method to detect a phase separation condition of a fluid from a subterranean involves obtaining a sample of the fluid, measuring a first characteristic value of the sample, measuring a second characteristic value of the sample and comparing the first characteristic value to a first reference value associated with a single-phase condition of the fluid to generate a corresponding first comparison result. The example method then compares the second characteristic value to a second reference value associated with the single-phase condition of the fluid to generate a corresponding second comparison result and detects the phase separation condition of the fluid based on the first and second comparison results.

26 Claims, 18 Drawing Sheets

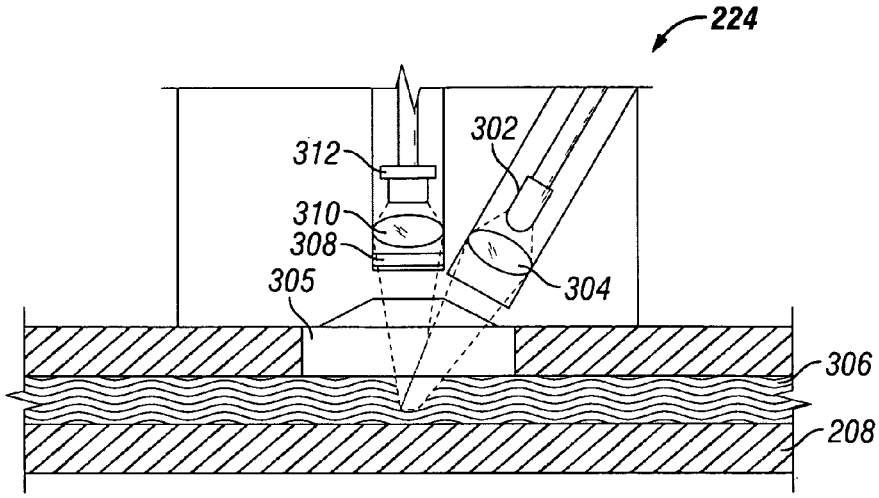

FIG. 3

400

| 402 SENSOR | 404 CHARACTERISTIC(S) MEASURED | 406 CAL. | 408 BUBBLE POINT | 410 DEW POINT | 412 ASPHALTENE PRECIP. | PHASE SEPARATION CONDITION |
|---|---|---|---|---|---|---|
| | | | LIQUID | GAS | LIQUID | INITIAL PHASE |
| | | | GAS | LIQUID | SOLID | SEPARATE PHASE |
| DENSITY | BULK DENSITY | REL. | I | I | I | |
| ACOUSTIC | ACOUSTIC IMPEDANCE | ABS./REL. | S(P) | I | I | |
| FLUORESCENCE/ REFLECTANCE | FLUORESCENCE | REL. | I | S | D | |
| | REFLECTANCE | ABS./REL. | S | D | I | |
| | METHANE PEAK | REL. | D | I | I | |
| SPECTROMETER | CHEMICAL COMPOSITION | REL. | I | I | I | |
| | SCATTERING | REL. | S | S | S(P) | |
| BACKSCATTERING | COLOR CONTRAST | REL. | | | S | |
| MEMS | DENSITY/FREQUENCY RESPONSE | REL. | S | S(P) | | |

FIG. 4

700

| | | ACOUSTIC IMPEDANCE | | |
|---|---|---|---|---|
| | | CHANGE | | NO CHANGE |
| SCATTERING | CHANGE | REFLECTANCE | | POSSIBLE MUD SOLIDS<br>USE MEMS TO RESOLVE AMBIGUITY |
| | | CHANGE | NO CHANGE | |
| | | LARGE AMT. GAS | SMALL AMT. GAS | |
| | NO CHANGE | POSSIBLE MEAS. ERROR<br>USE MEMS TO RESOLVE AMBIGUITY | | NO GAS SEPARATION |

*FIG. 7*

800

| | | MEMS FREQUENCY RESPONSE | | |
|---|---|---|---|---|
| | | CHANGE | | NO CHANGE |
| SCATTERING | CHANGE | FLUORESCENCE | | POSSIBLE MUD SOLIDS OR MEASUREMENT ERROR |
| | | CHANGE | NO CHANGE | |
| | | LARGE AMT. GAS | SMALL AMT. LIQUID (MIST) | |
| | NO CHANGE | POSSIBLE MEAS. ERROR<br>USE FLUORESCENCE AND REFLECTANCE TO RESOLVE AMBIGUITY | | NO LIQUID SEPARATION |

*FIG. 8*

| | | SCATTERING TEMPORAL PATTERN/BACKSCATTERING | |
|---|---|---|---|
| | | CHANGE/NO CHANGE | NO CHANGE/CHANGE |
| SCATTERING | CHANGE | SOLID SEPARATION (ASPHALTENE PRECIPITATION) | POSSIBLE MUD SOLIDS OR GAS BUBBLES |
| | NO CHANGE | NO SOLID SEPARATION (ASPHALTENE PRECIPITATION) | NO SOLID SEPARATION (ASPHALTENE PRECIPITATION) |

| PRESSURE (PSI) | C1 (WT%) | C2 (WT%) | C3-5 (WT%) | C6+ (WT%) | CO2 (WT%) |
|---|---|---|---|---|---|
| 9,500 | 26.3 | 14.7 | 12.6 | 1.3 | 45.1 |
| 5,000 | 26.3 | 13.9 | 13.3 | 0.8 | 45.6 |

| PRESSURE (PSI) | C1 (WT%) | C2 (WT%) | C3-5 (WT%) | C6+ (WT%) | CO2 (WT%) |
|---|---|---|---|---|---|
| 11,000 | 42.8 | 0.0 | 0.0 | 17.7 | 39.5 |
| 6,000 | 49.5 | 0.0 | 0.0 | 17.1 | 33.3 |

PHASE SEPARATION DETECTION IN DOWNHOLE FLUID SAMPLING

BACKGROUND OF THE DISCLOSURE

In sampling and analyzing fluid samples from a subterranean formation, the phase condition of the extracted sample can have a significant impact on the validity or accuracy of the analysis results. Ideally, a formation fluid sample is extracted and analyzed as a homogeneous phase or substantially single-phase fluid. However, in practice, changes in pressure and/or temperature can cause a sample to become multi-phase in which, for example, a gas separates from a liquid phase, a liquid separates from a gas phase, or a solid separates from a liquid phase. Such phase separations can compromise the validity or accuracy of a fluid analysis of a sample because the emerging phase usually has a different composition and/or physical properties (e.g., density, viscosity, etc.) than the original phase. As a result, any analysis performed on such a multi-phase sample will no longer be representative of pristine formation fluid, thereby rendering any drilling or other production decisions based on the multi-phase sample as potentially flawed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 3 is a schematic block diagram according to one or more aspects of the present disclosure.

FIG. 4 depicts an example table according to one or more aspects of the present disclosure.

FIG. 7 is an example table according to one or more aspects of the present disclosure.

FIG. 8 is an example table according to one or more aspects of the present disclosure.

DETAILED DESCRIPTION

Figure 1:
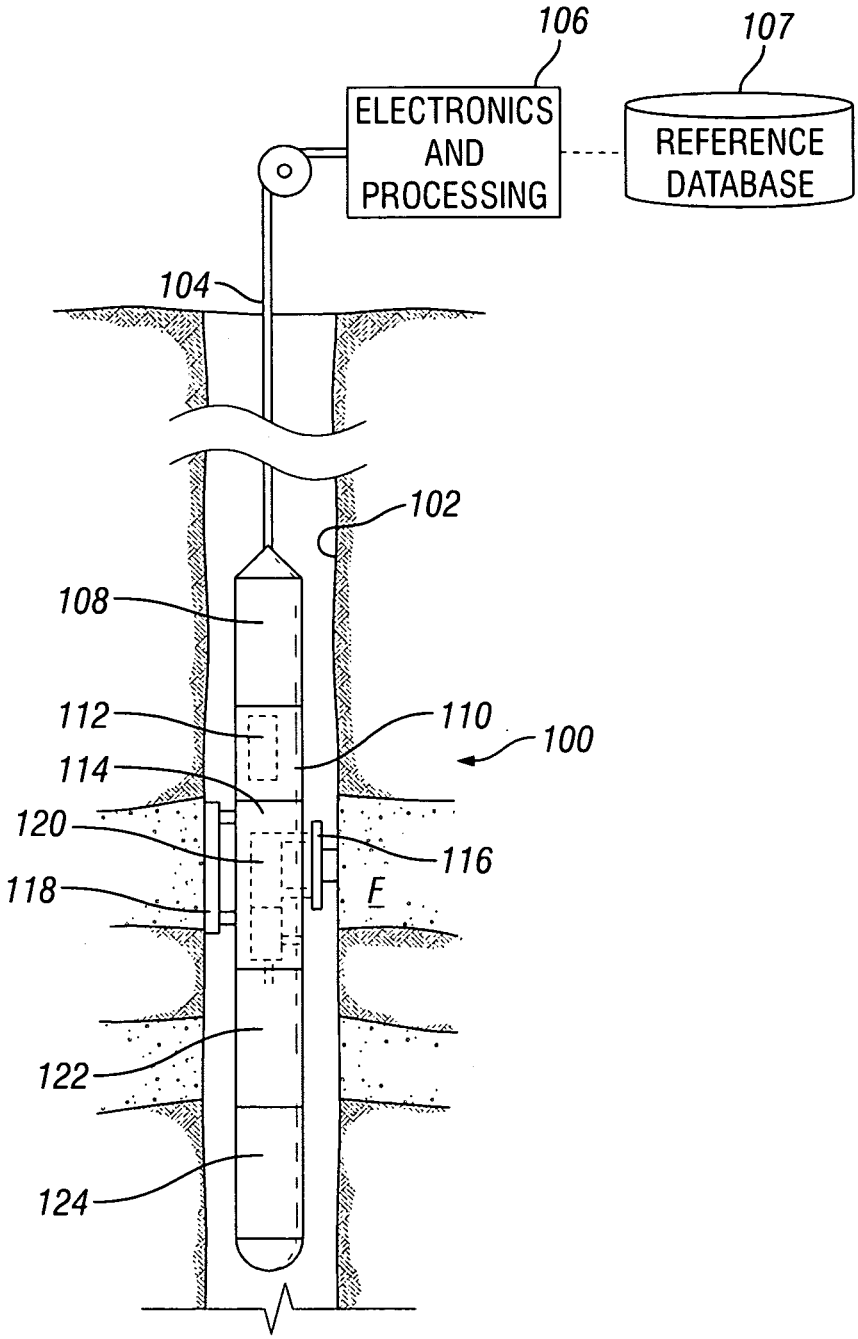
FIG. 1 depicts an example wireline tool that may be used to extract and analyze formation fluid samples according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Hydrocarbon fluids from subterranean formations are typically composed of molecules ranging from methane (C1) to heavier molecules (e.g., C12+). Phase separations occur in these fluids when the pressure to which the fluid is subjected falls below the saturation pressure of certain components of the fluids at a given temperature. Those components typically precipitate as a second phase and cause a change in the chemical composition of the fluid. However, at the onset of such a phase separation, the overall effect of the phase separation on chemical composition of the fluid sample is minute and, thus, very difficult to detect reliably. To overcome this difficulty in reliably detecting phase separations, particularly the onset of these phase separations, the example methods and apparatus described herein recognize that as phase separation of a fluid sample onsets, the fluid sample becomes non-uniform and one of the multiple phases may exhibit a higher affinity for a sensor surface than another phase, thereby changing the sensor response. Accordingly, the example methods and apparatus described herein employ techniques that measure fluid sample characteristics that are associated with uniformity (or non-uniformity) of the sample and/or characteristics that are associated with certain phases exhibiting an affinity for a sensor surface.

The example methods and apparatus described herein may be configured to accurately detect phase separations in downhole fluid sampling operations. While the examples are described in connection with a wireline sampling apparatus, the examples described herein may also be used with any other type of conveyance including, for example, drill string conveyances including logging-while-drilling (LWD) equipment and/or measurement-while-drilling (MWD) equipment, coiled tubing, permanent measurement applications, laboratory measurements (e.g., during PVT measurements), etc. Further, while the examples described in detail below are directed to detecting phase separations associated with hydrocarbon fluids, the apparatus and methods described herein may also be more generally applied. For instance, operations involving water zones in subterranean formations may employ the example methods and apparatus described herein to detect dissolved gas (e.g., CO2) in the water zones. Such dissolved gas may be naturally occurring in a water zone and/or may be due to sequestration (e.g., CO2 injected into a water zone associated with one well traveling to another distant well that is being sampled and affecting the sampling operations at that distant well). Additionally, while certain preferred embodiments are disclosed herein, other embodiments may be utilized and structural changes may be made without departing from the scope of the present disclosure.

In general, the example methods and apparatus described in greater detail below may employ a sensor fusion technique that uses at least two measured characteristic values for a given fluid sample from a subterranean formation to detect a phase separation condition of a hydrocarbon fluid or other fluid (e.g., water). The measured characteristic values, which are generally related to physical rather than chemical properties of the fluid sample, may be compared to respective reference values that are associated with a substantially single-phase condition of the fluid. Each such comparison may provide a result that is either indicative of the presence of a phase separation or the absence of the phase separation. By using multiple such comparison results to detect the phase separation condition, a more robust or reliable determination of the presence or absence of the phase separation can be made.

More specifically, in the case where two comparison results are used, a phase separation of the fluid may be detected if each of the first and second comparison results indicates the presence of the phase separation. On the other hand, substantially no phase separation of the fluid may be detected if neither of the first and second comparison results indicates the presence of the phase separation. However, if one of the first and second comparison results indicates the presence of the phase separation and the other one of the first and second comparison results indicates the absence of the phase separation condition, an ambiguous phase separation result may be provided. To resolve ambiguous phase separation results, the example methods and apparatus described herein may employ one or more additional different characteristic values and corresponding reference values, each of which is associated with a substantially single-phase condition of the fluid.

In the examples described herein, the presence of a phase separation may be indicated by any one of the comparison results when the characteristic value corresponding to that comparison result is substantially different than the reference value corresponding to that comparison result. Conversely, the absence of the phase separation may be indicated by any one of the comparison results when the characteristic value corresponding to that comparison result is substantially the same as the reference value corresponding to that comparison result. In other words, because the characteristic values generally correspond to physical properties of a fluid being sampled, and because the reference values correspond to a substantially single-phase condition of the fluid, any substantial difference or change of a characteristic value relative to its corresponding reference value is likely indicative of a physical change (e.g., a phase change) in the fluid. Further, when multiple characteristic values consistently indicate the presence or absence of such a physical change (or phase change), the certainty with which the change can be determined or identified increases dramatically, thereby dramatically increasing the confidence with which decisions to change drilling, sampling and/or production parameters can be made as well as the resulting effectiveness of such decisions.

In the examples described in greater detail below, the measured characteristic values may include two or more of an optical scattering characteristic, an acoustic impedance, a resonant frequency of a micro electromechanical systems (MEMS) sensor, a temporal characteristic of the optical scattering characteristic, or a backscattering characteristic. The two or more measured characteristic values may be used to detect a gas separating from a liquid (e.g., a bubble point), a liquid separating from a gas (e.g., a dew point), or a solid separating from a liquid (e.g., asphaltene precipitation).

In examples described herein, detecting a phase separation condition of a fluid from a subterranean formation may involve measuring a composition of a sample of the fluid at a plurality of pressures and detecting the phase separation condition of the fluid based on the variability of the composition for the plurality of pressures.

Additionally, in the examples described herein, the detected phase separation condition(s) may be used to generate an output (e.g., a numerical value, text, graphical information, etc.) indicative of the phase separation condition. This output may be presented via, for example, a video display, printer, etc. to a person performing a sampling operation at a wellbore penetrating a subterranean formation from which the fluid sample was drawn.

In at least one example described herein, detecting a phase separation condition involving a gas separating from a liquid (e.g., a hydrocarbon fluid) involves measuring an optical scattering characteristic value (e.g., an attenuation measured via a spectrometer) and an acoustic impedance value of a fluid sample and indicating the presence of the gas if the each of these values indicates the presence of the phase separation. If the separating gas phase is detected, a reflectance value of the sample is measured and used to indicate a relative amount of the gas in the sample. If an ambiguous phase separation result is obtained, the presence of mud solids may be preliminarily indicated. An increased confidence in the resolution of the ambiguous phase separation result may be provided by using at least one of the resonant frequency of the MEMS sensor or the temporal characteristic of the optical scattering characteristic to indicate the presence of the mud solids or the absence of the gas.

Detecting a phase separation condition involving a liquid separating from a gas may also or alternatively involve measuring an optical scattering characteristic (e.g., an attenuation value via a spectrometer) and the resonant frequency of the MEMS sensor and indicating the presence of the liquid if each of these values indicates the presence of the phase separation. If the presence of the separating liquid phase is detected, a fluorescence value of the sample may be measured and used to indicate a relative amount of the liquid. If an ambiguous phase separation result is obtained, the presence of mud solids or a measurement error may be indicated. An increased confidence in the resolution of the ambiguous phase separation result may be provided by using at least one of the resonant frequency of the MEMS sensor, the fluorescence value or a reflectance value to indicate the presence or the absence of the liquid.

In yet another example described herein, detecting a phase separation involving a solid separating from a liquid involves measuring the temporal pattern of the optical scattering characteristic or the backscattering characteristic and indicating the presence of the solid if each of these measured characteristics indicates the presence of the phase separation. If an ambiguous phase separation result is obtained, the presence of gas bubbles or mud solids may be indicated.

In the examples described herein, the reference values are associated with a substantially single-phase condition of the hydrocarbon fluid or other fluid (e.g., water) being sampled. However, in some cases, as described in greater detail below in connection with FIG. 4, the reference values are relative references values, which are determined based on (e.g., during a calibration using) the sample of fluid that is being analyzed for a phase separation condition. In other cases, the reference values are absolute reference values and may be determined using a standard in, for example, a lab test at the surface.

To ensure that the reference values correspond to a substantially single-phase condition of the fluid, the pressure of the fluid may be changed (e.g., increased) to a level that is known to provide a single-phase condition. Various ones of the characteristic values can be monitored while the pressure is changed and when the characteristic values are substantially invariant or constant with further changes in the pressure, the fluid is deemed to be substantially single phase.

Further, for examples using optical scattering measurements based on optical density outputs from a downhole fluid analyzer (e.g., a spectrometer), example methods and apparatus to identify inaccurate optical density channels are also described herein. One example method involves measuring a composition of the sample at a plurality of times and identifying an inaccurate optical density measurement based on the variability of the composition for the plurality of times. In the described examples, one or more optical density channels of a downhole fluid analyzer providing optical density values that do not substantially vary or which do not vary in proportion to optical density values obtained from at least one other optical density channel of the downhole fluid analyzer for the plurality of times may be identified as potentially inaccurate. The optical density channel(s) identified as inaccurate may correspond to content of carbon dioxide or a hydrocarbon.

For example, measuring the composition of the sample at the plurality of times may involve measuring the composition of the sample at a plurality of pressures or fluid densities greater than or equal to a pressure at which the sample is substantially single phase. Thus, those optical density channels that provide an output (e.g., optical density values) that do not vary substantially or in proportion to other channels as the pressure or density changes are likely inaccurate (e.g., have an offset error).

In another example, measuring the composition of the sample at the plurality of times involves measuring the composition of the sample at times corresponding to different levels of contamination in the sample. For example, when initially drawing a hydrocarbon fluid sample from a formation, a relatively high level of contamination (e.g., oil-based mud filtrate) may be present in the sample. However as fluid is pumped from the formation, the level of contamination decreases. As a result, the composition of the sample changes over time as the level of contamination relative to the level of pristine hydrocarbon fluid changes (i.e., the sample cleans up). In other words, for those components that usually exist only in pristine hydrocarbon fluid, such as C1 and CO2, their weight percentages tend to increase as sampling time increases. Thus, with the example method described herein, an optical density channel of the fluid analyzer that corresponds to varying components but which provides a substantially constant output for the different levels of filtrate contamination (i.e., over time) is indicative of an inaccurate channel (e.g., a channel that has an offset error).

FIG. 1 depicts an example wireline tool 100 that may be used to extract and analyze formation fluid samples in accordance with the example methods and apparatus described herein. As shown in FIG. 1, the example wireline tool 100 is suspended in a borehole or wellbore 102 from the lower end of a multiconductor cable 104 that is spooled on a winch (not shown) at the surface. At the surface, the cable 104 is communicatively coupled to an electronics and processing system 106. The electronics and processing system 106 may include or be communicatively coupled to a reference database 107 that may be used to store reference measurement values of reference formation fluids known to have particular fluid compositions, densities, and any other parameters or characteristics. The wireline tool 100 includes an elongated body 108 that includes a collar 110 having a downhole control system 112 configured to control extraction of formation fluid from a formation F, perform measurements on the extracted fluid, and to control the apparatus described herein to determine a phase separation condition of the extracted formation fluid.

The example wireline tool 100 also includes a formation tester 114 having a selectively extendable fluid admitting assembly 116 and a selectively extendable tool anchoring member 118 that are respectively arranged on opposite sides of the elongated body 108. The fluid admitting assembly 116 is configured to selectively seal off or isolate selected portions of the wall of the wellbore 102 to fluidly couple to the adjacent formation F and draw fluid samples from the formation F. The formation tester 114 also includes a fluid analysis module 120 through which the obtained fluid samples flow. The sample fluid may thereafter be expelled through a port (not shown) or it may be sent to one or more fluid collecting chambers 122 and 124, which may receive and retain the formation fluid samples for subsequent testing at the surface or a testing facility.

In the illustrated example, the electronics and processing system 106 and/or the downhole control system 112 are configured to control the fluid admitting assembly 116 to extract fluid samples from the formation F and to control the fluid analysis module 120 to measure the fluid samples. In some example implementations, the fluid analysis module 120 may be configured to analyze the measurement data of the fluid samples as described herein. In other example implementations, the fluid analysis module 120 may be configured to generate and store the measurement data and subsequently communicate the measurement data to the surface for analysis at the surface. Although the downhole control system 112 is shown as being implemented separate from the formation tester 114, in some example implementations, the downhole control system 112 may be implemented in the formation tester 114.

As described in greater detail below, the example wireline tool 100 may be used in conjunction with the example methods and apparatus described herein to determine a phase separation condition of a formation fluid sample. For example, the formation tester 114 may include one or more sensors, fluid analyzers and/or fluid measurement units disposed adjacent a flowline and may be controlled by one or both of the downhole control system 112 and the electronics and processing system 106 to determine the composition of as well as other characteristics of fluid samples extracted from, for example, the formation F. More specifically, the example wireline tool 100 is configured to extract fluid samples from the formation F and to determine, based on comparisons of measured characteristic values and corresponding reference characteristic values associated with a substantially single-phase condition of the extracted fluid type and/or a measured variability of a composition of the sample, whether the extracted sample is substantially single phase or whether the sample exhibits a phase separation such as a gas separating from a liquid, a liquid separating from a gas, or a solid separating from a liquid using the example techniques described herein. Further, the example wireline tool 100 is configured to identify one or more inaccurate optical density channels of a fluid analyzer (e.g., a fluid analyzer 200 of FIG. 2) in the formation tester 114 based on the variability of a composition of the extracted fluid sample for a plurality of pressures and/or for a range of different contamination levels (e.g., as an oil-based mud concentration in the extracted fluid changes during a sampling process).

The data processing associated with the example methods described herein may be performed by a processing unit (e.g., similar to the processing unit P100 of FIG. 21) in the formation tester 114 and/or within the fluid analysis module 120, the downhole control system 112, the electronics and processing system 106, and/or within any other processing unit local or remote relative to the wireline tool 100.

Figure 2:
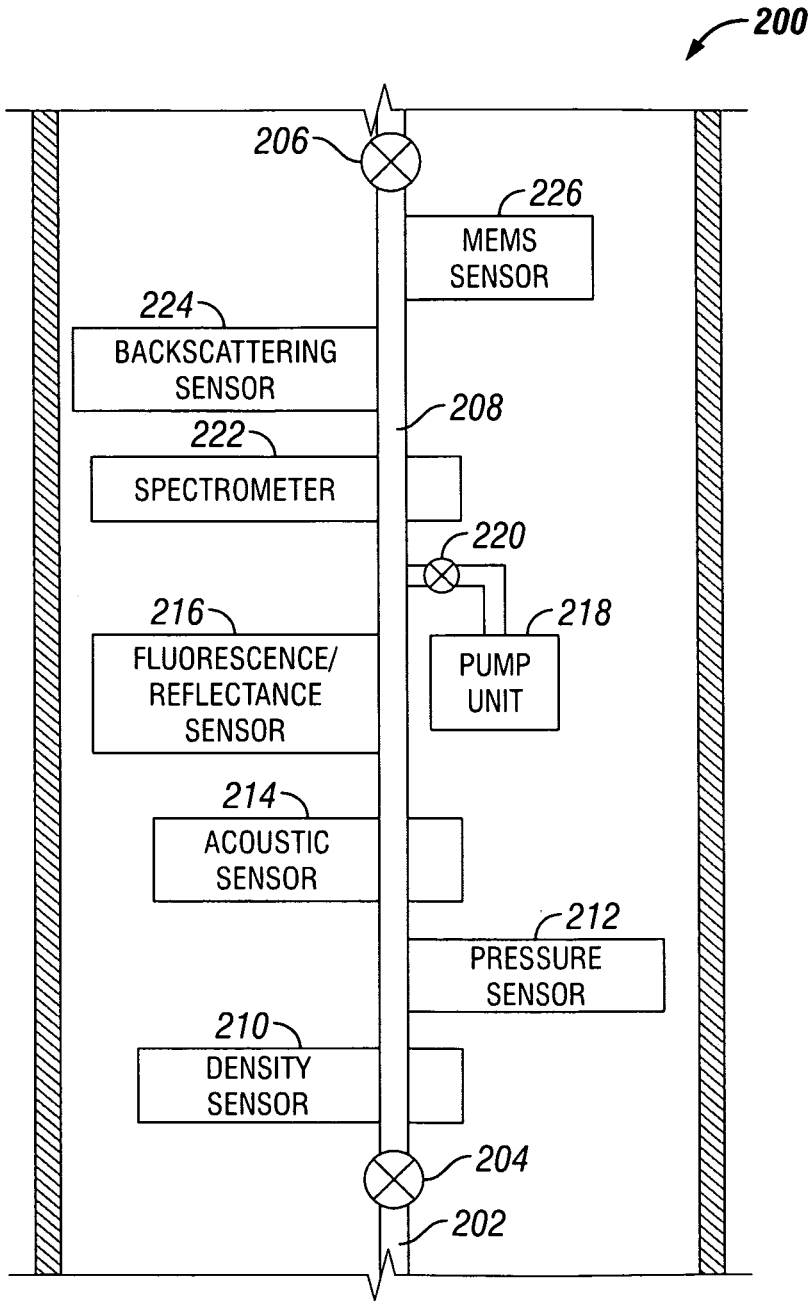
FIG. 2 depicts a block diagram of an example fluid analyzer according to one or more aspects of the present disclosure.

FIG. 2 depicts a block diagram of an example fluid analyzer 200 that may be used to implement the fluid analysis module 120 of the formation tester 114 (FIG. 1). The example fluid analyzer 200 includes a flowline 202 that may be fluidly coupled to the fluid admitting assembly 116 (FIG. 1) to receive fluid samples from the formation F during a sampling operation. The fluid analyzer 200 includes valves 204 and 206, which can be selectively activated to isolate a section 208 of the flowline 202 to facilitate changing the pressure of the fluid sample during testing of the fluid sample as described in greater detail below.

As depicted in FIG. 2, the example fluid analyzer 200 includes a density sensor 210, which may be implemented as an X-ray density meter coupled to the flowline 202 to measure a bulk density of a fluid sample. A pressure sensor 212 is also coupled to the flowline 202 to measure the pressure of the fluid sample in the flowline section 208. The pressure sensor 212 may be implemented as a quartz or sapphire gauge pressure sensor. An acoustic sensor 214 coupled to the flowline 202 may be used to determine the acoustic impedance of the fluid sample in the flowline section 208. The acoustic sensor 214 may be implemented as an ultrasonic transducer. The example fluid analyzer 200 also includes a fluorescence/reflectance sensor 216, which may be implemented as a gas cell having a sapphire window.

A pump unit 218 is selectively fluidly coupled to the flowline 202 via a valve 220. The pump unit 218 may be used to increase or decrease a pressure of the sample fluid. In particular, the pump unit 218 may be operated in conjunction with the valves 204, 206 and 220 to function as a pressure volume control unit (PVCU) that controls the pressure of a fluid sample isolated in or flowing through the flowline section 208. For example, as described in greater detail below, the pump unit 218 may be used to increase the pressure of a fluid sample in the flowline section 208 to ensure that the fluid sample is substantially single phase during a calibration process to obtain reference characteristic values for the fluid sample.

The example fluid analyzer 200 also includes a spectrometer 222 having a plurality of optical density channels (e.g., between twenty and thirty-six channels) associated with wavelengths between 400 nanometers (nm) and 2050 nm. Each of the channels measures an optical attenuation at a particular wavelength or band of wavelengths, which are selected to be sensitive to sample coloration or color contrast, chemical composition, scattering, etc. A backscattering sensor 224 is also coupled to the flowline section 208. The backscattering sensor 224 may be used to measure the gray scale of a fluid sample to, for example, distinguish between the presence of asphaltenes and mud solids in the event that an ambiguous phase separation result indicating the possible presence of a solid phase is obtained. While the backscattering sensor 224 is depicted as a separate block in FIG. 2, the backscattering sensor 224 could be implemented or integrated within the fluorescence/reflectance sensor 216 as depicted and described in connection with FIG. 3.

The example fluid analyzer 200 also includes a micro-electro-mechanical systems (MEMS) sensor 226. The MEMS sensor 226 includes a flexible plate that vibrates in the fluid sample. The resonant frequency and quality factor of the frequency response of the plate vary based on the density and viscosity of the fluid surrounding the plate. Additionally, the frequency response of the MEMS sensor 226 is sensitive to fluid (e.g., droplets) and/or air bubbles forming on its surfaces and, thus, as described in connection with the example phase separation detection techniques described herein, the MEMS sensor 226 may be used to identify the separation of a liquid phase from a gas (i.e., in response to liquid droplets forming or condensing on the vibrating plate of the sensor 226) or the separation of a gas phase from a liquid (i.e., in response to gas bubbles forming on the vibrating plate of the sensor 226).

While an example manner of implementing the example fluid analyzer 120 of FIG. 1 has been illustrated in FIG. 2, one or more of the interfaces, data structures, elements, processes and/or devices illustrated in FIG. 2 may be combined, divided, re-arranged, omitted, eliminated, implemented in a recursive way, and/or implemented in any other way. For example, one or more of the operations or functions of the example fluid analyzer 200 may be implemented at the surface. Further, the example sensors 210, 212, 214, 216, 222, 224 and 226 may be implemented by hardware, software, firmware and/or any combination of hardware, software and/or firmware. Thus, for example, any or all of the example blocks shown within the example fluid analyzer 200 may be implemented by one or more circuit(s), programmable processor(s), application specific integrated circuit(s) (ASIC(s)), programmable logic device(s) (PLD(s)) and/or field programmable logic device(s) (FPLD(s)), etc. Further still, the example fluid analyzer 200 may include interfaces, data structures, elements, processes and/or devices instead of, or in addition to, those illustrated in FIG. 2 and/or may include more than one of any or all of the illustrated interfaces, data structures, elements, processes and/or devices.

FIG. 3 is a schematic block diagram illustrating one manner of implementing the example backscattering sensor 224 of FIG. 2. As shown in FIG. 3, the backscattering sensor 224 includes a light emitting diode (LED) 302 that transmits its light output through a lens 304 and a sapphire window 305 to a fluid sample 306 in the flowline section 208. The lens 304 may be configured to focus the light emitted by the LED 302 on the middle of the fluid sample 306 stream. Incident light from the fluid sample 306 may pass through a linear polarizer 308, which serves to eliminate background scattering and specular reflection, and a lens 310 and finally a photodiode 312, which produces the backscattering signal. The backscattering sensor 224 enables detection of an intensity difference in backscattering, which results from color contrast within the fluid sample 306 and, thus, this intensity difference may be used to discriminate between asphaltenes, which are relatively black in color, and mud solids, which are relatively gray or lighter in color.

As noted above, the example phase separation detection techniques described herein use two or more sensors, characteristic values of a sample fluid, etc. to provide a more robust, accurate identification of the onset of a phase separation in a fluid sample extracted from a subterranean formation. For example, the scattering (e.g., attenuation at one or more particular wavelengths) exhibited by a fluid sample is indicative of the degree of non-uniformity of the sample. In other words, as a separating phase onsets and increases in amount in the fluid sample, the non-uniformity of the sample (and, thus, the attenuation or scattering) increases. As a result, scattering measurements can be used to detect a gas separating from a liquid, a liquid separating from a gas, and/or a solid separating from a liquid. However, the presence of mud solids in a liquid can also produce increased scattering or attenuation, which could result in an ambiguous phase separation detection result if one or more measurements in addition to the scattering measurement are not made to resolve the ambiguity.

FIG. 4 depicts an example table 400 comparing the sensitivities of the various sensors in the example fluid analyzer 200 (FIG. 2) to phase separations. A first column 402 of the table 400 contains the sensors 210, 214, 216, 222, 224 and 226 of the example fluid analyzer 200 of FIG. 2. A second column 404 lists the fluid characteristic(s) measured by each of the sensors of the first column 402. A third column 406 indicates the type of calibration used for each of the sensors in the first column 402 to enable these sensors to measure accurately the corresponding fluid characteristics in the second column 404. In general, each of the sensors in the first column 402 is calibrated to generate a reference value corresponding to a substantially single-phase condition of the fluid sample. In this manner, subsequent measurements made by each of the sensors can be compared to the single-phase reference value for that sensor and, if a measurement value is substantially different than the reference value for that sensor, a phase separation may be indicated as a result of that comparison. On the other hand, if a measurement value is not substantially different than the reference value for that sensor, then no phase separation condition may be indicated as a result of the comparison.

As indicated in the table 400, certain sensors and fluid characteristic measurements use a relative calibration process to generate a reference value (indicated as "Rel." in the table 400), while other fluid characteristic measurements use an absolute calibration process or, alternatively, a relative calibration process to generate a reference value (indicated as "Abs./Rel." in the table 400). Relative calibrations are performed live (e.g., downhole) using the sample fluid on which phase separation detection is to be performed. In other words, a relative calibration develops a reference value for (i.e., relative to) the particular sample of fluid to be analyzed for phase separation. An absolute calibration, on the other hand, develops a reference value using a standard fluid and may, for example, be performed at the surface in a laboratory environment. In the table 400, for example, acoustic impedance is indicated as using an absolute calibration (or, alternatively, a relative calibration process) to enable changes in acoustic impedance to be used to detect phase separations. For example, the acoustic impedance of a gas-free oil standard can provide an absolute reference that enables detection of a downhole oil sample having a separating gas phase. However, as shown in the table 400, scattering measurements, for example, use a relative calibration to enable changes in scattering characteristics (e.g., attenuation of one or more particular spectrometer channels) to be used to detect phase separations. More specifically, the optical density measured at particular channels for a single-phase oil sample varies with the composition and color of the oil sample and, thus, reference values indicative of the attenuation or scattering characteristics of a single-phase condition are sample dependent. To ensure that the relative calibrations for sensors and their corresponding fluid characteristics measurements provide reference values associated with a single-phase condition, a calibration process such as that described in connection with FIG. 5 below may be performed.

The example table 400 also includes three columns 408, 410 and 412, which correspond to a gas separating from a liquid, a liquid separating from a gas, and a solid separating from a liquid, respectively. Below each of the columns 408, 410 and 412, the sensitivity of each of the fluid characteristics listed in column 404 is indicated as "I," which corresponds to insensitive, "D," which corresponds to detectable, and "S," which corresponds to sensitive. Additionally, "(P)" indicates that a fluid characteristic may be used as a primary indicator of the phase separation associated with the column in which it appears. Thus, acoustic impedance may be used as a primary indicator of a gas separating from a liquid, the frequency response of the MEMS sensor may be used as a primary indicator of a liquid separating from a gas, and scattering may be used as a primary indicator of a solid separating from a liquid (e.g., asphaltene precipitation).

In accordance with the example phase separation techniques described herein, each of the three types of phase separations may be detected using a combination of two or more fluid characteristics to reduce ambiguity and provide more accurate, reliable phase separation detection results. From the example table 400 it can be seen that for each phase separation condition (columns 408, 410 and 412), there are multiple fluid characteristics that are sensitive (i.e., marked "S" or "S(P)") to that phase separation condition. Thus, for example, a more accurate and reliable detection of the onset of a gas separating from a liquid (i.e., bubble point) may be achieved by using a combination of fluid characteristic measurements including two or more of acoustic impedance, scattering, a frequency response of the MEMS sensor, and reflectance. Likewise, a more accurate and reliable detection of the onset of a liquid separating from a gas (i.e., a dew point) may be achieved by using a combination of fluid characteristic measurements including two or more of a frequency response of the MEMS sensor, scattering, and fluorescence. Further, a more accurate and reliable detection of the onset of a solid separating from a liquid (e.g., asphaltene precipitation) may be achieved by using fluid characteristics including one or more of scattering and backscattering.

Figure 5:
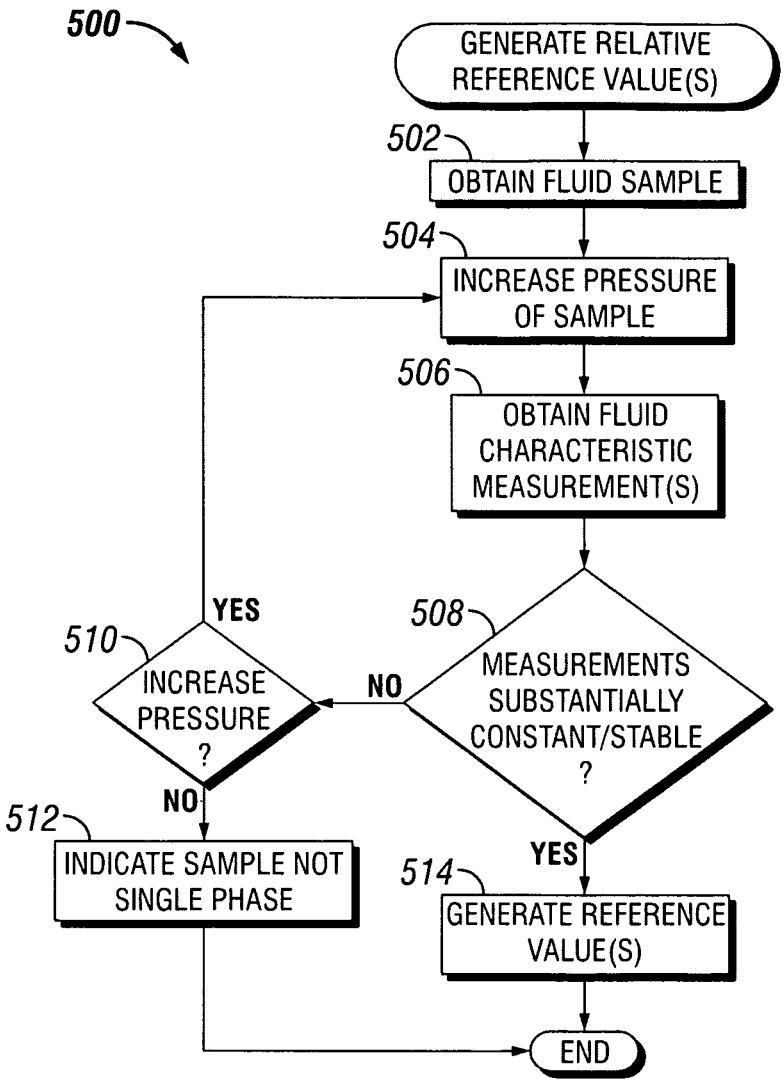
FIG. 5 depicts an example process according to one or more aspects of the present disclosure.

FIG. 5 depicts an example process 500 that may be used to perform a calibration of the example fluid analyzer 200 of FIG. 2 to obtain reference values for fluid characteristic measurements needing a relative calibration (i.e., a calibration based on the fluid sample for which phase separations are to be detected). The example process 500 initially obtains a fluid sample (block 502) by, for example, pumping a clean fluid sample (e.g. a fluid sample having a relatively low amount of contamination such as filtrate contamination) into the flowline 202 (FIG. 2) and may isolate a portion of the sample in the flowline section 208 with the valves 204 and 206. The pressure of the sample in the flowline section 208 is then increased (e.g., via the pump unit 218) to a level that exceeds saturation pressure for the expected constituents of the sample fluid at the temperature of the sample fluid (block 504). It should be understood that isolation of the fluid sample in the flowline section 208 is not necessarily required to enable the pressure of the sample to be changed (e.g., increased). Alternatively, the fluid sample can be introduced into the flowline section 208 at a relatively high pressure, thereby eliminating the need for the above-mentioned pressurization operation. For example, a pressure of 15 kpsi may be sufficient to ensure that the sample pressure exceeds such a saturation pressure. The pressure increase at block 504 may be halted, at least momentarily, to enable one or more fluid characteristics to be measured (e.g., any of the characteristics illustrated in the table 400 of FIG. 4) (block 506). In some cases, the fluid characteristic(s) measured at block 506 are those for which reference values are currently being generated. However, in other cases, any other fluid characteristic(s) may be used to assess whether the fluid sample is in a substantially single-phase condition at block 508. At block 508, the example process 500 analyzes the measurement values obtained at block 506 (e.g., by looking at several sets of measurement values made at different times and pressures) to determine whether the measurement values have stabilized (e.g., are substantially constant for a plurality of different measurements at different times and pressures). If the measurements have not stabilized (block 508), the example process 500 determines whether the pressure is to be increased further (block 510). If the pressure is to be increased (block 510), control returns to block 504, thereby causing another set of measurement values to be obtained. If the pressure is not to be increased (e.g., cannot be increased further) (block 510), then the sample fluid is indicated as not being single phase (i.e., multi-phase) (block 512) and the process 500 ends.

On the other hand, if the measurements are deemed to be stable or substantially constant at block 508, the example process 500 generates one or more reference values (block 514). The reference values generated at block 514 may be the measurement values last obtained at block 506 and/or may be some combination of sets of reference values obtained during multiple passes through block 506 and which are deemed to be stable or substantially constant. The reference value(s) generated at block 514 may be stored in the example fluid analyzer 200 (FIG. 2), the downhole control module 112 (FIG. 1), the electronics and processing unit 106 and/or the reference database 107.

Figure 6A:
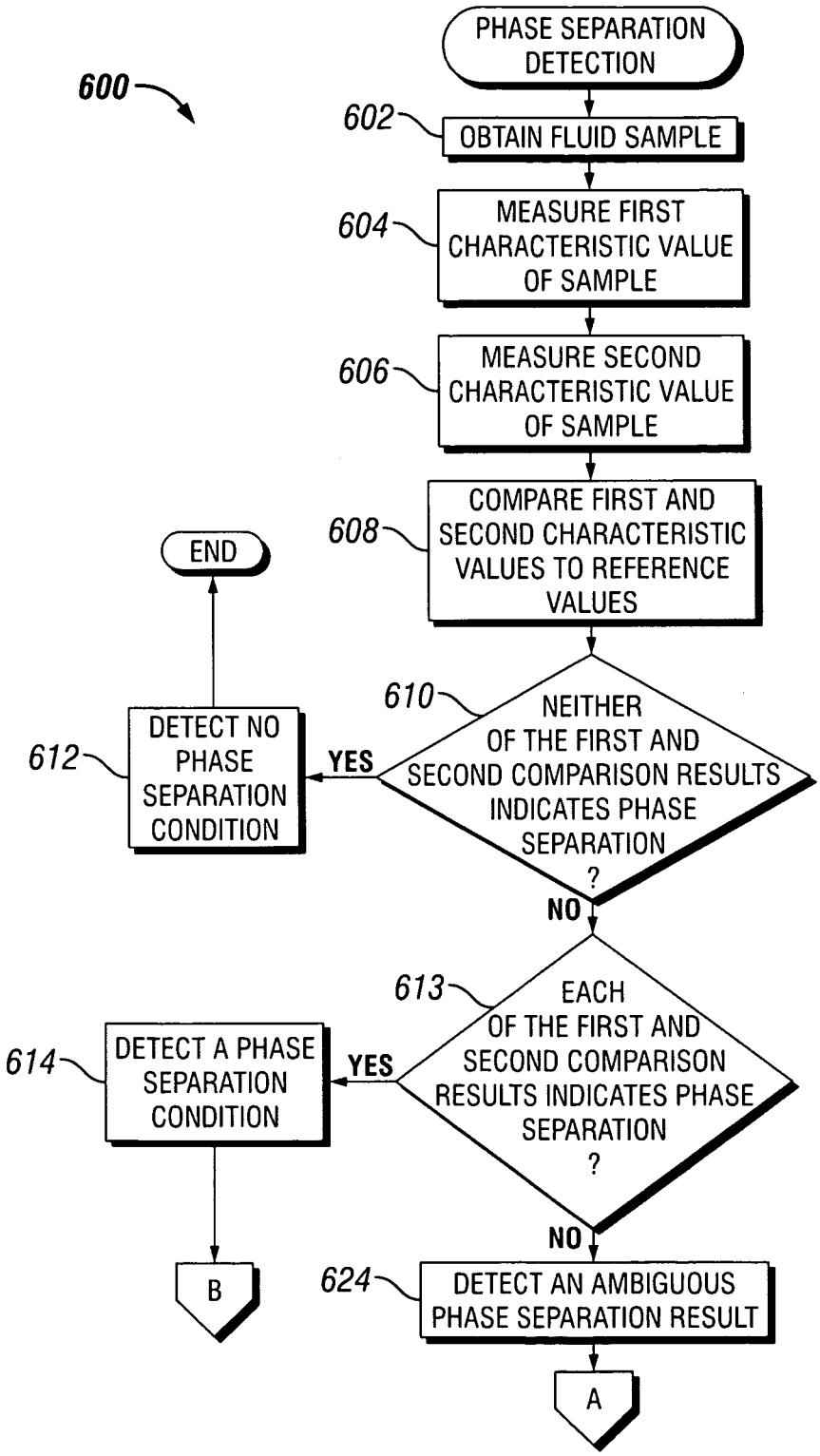
FIGS. 6A and 6B depict an example process according to one or more aspects of the present disclosure.
Figure 6B:
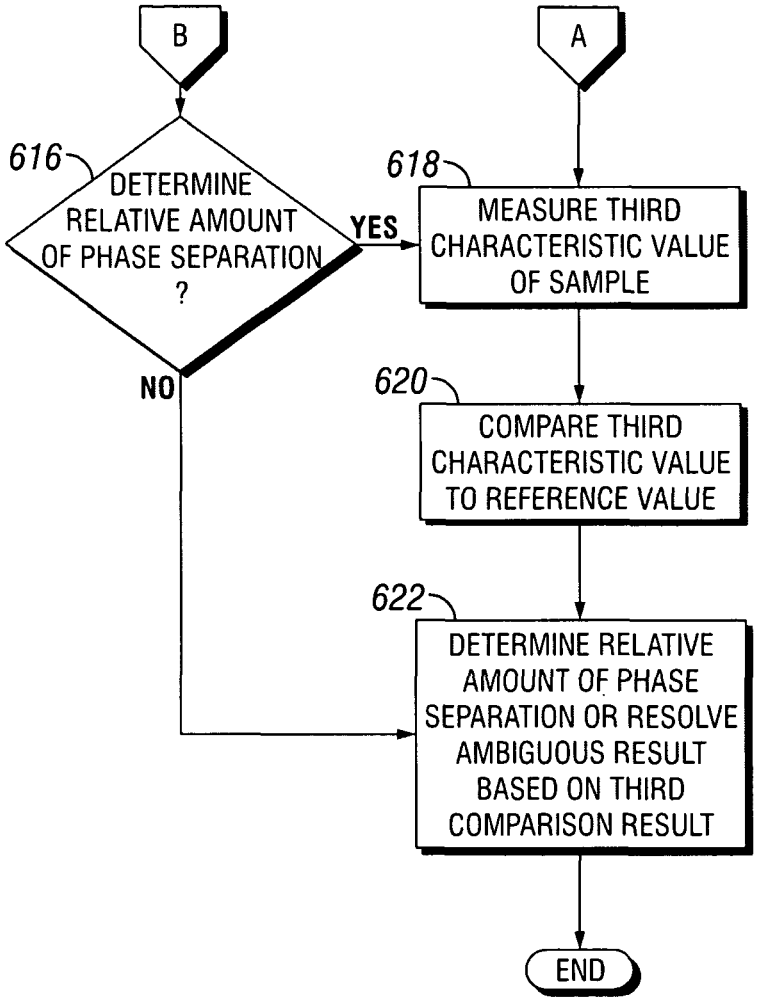

FIGS. 6A and 6B depict an example process 600 that may be used with the example apparatus described herein to detect phase separations in a fluid sample from a subterranean formation. More specific implementation examples of the general process illustrated in FIGS. 6A and 6B are described in connection with FIGS. 7, 8 and 9 below. Turning to the general process 600 of FIGS. 6A and 6B, a fluid sample is initially obtained (block 602) by, for example, collecting a fluid sample in the flowline section 208 (FIG. 2). Then, the example process 600 measures a first characteristic value of the sample (block 604) and a second characteristic value of the sample (block 606). The characteristic values measured at blocks 604 and 606 may be selected using, for example, the information provided in the table 400 to enable the detection of a particular phase separation condition (e.g., bubble point, dew point, asphaltene precipitation, etc.). While the example process 600 uses two characteristic values to detect a particular one of several possible phase separation conditions, the example process 600 may be more generally applicable to more than two characteristic values to detect a given phase separation condition and/or may be used to measure multiple sets of characteristic values, where each set of values corresponds to a different phase separation condition. However, for purposes of clarity of explanation, the example process 600 of FIGS. 6A and 6B is described as including two or three characteristic values for a particular phase separation condition.

After measuring the characteristic values (blocks 604 and 606), the example process 600 compares the characteristic values to respective corresponding reference values (block 608), which may have previously been determined via an absolute calibration process or via a relative calibration process such as the example process 500 of FIG. 5. The comparisons at block 608 yield comparison results such that a phase separation is indicated if the comparison indicates that a measured value (e.g., measured at block 604 or 606) is substantially different than its corresponding reference value. Conversely, no phase separation is indicated if the comparison indicates that the measured value is substantially the same as its corresponding reference value. Thus, at block 610, if neither of the comparison results indicates a phase separation, the example process 600 indicates that no phase separation is detected (block 612) and the process 600 ends. If one or both of the comparison results indicates phase separation, control proceeds to block 613, at which the example process 600 determines whether each (both) of the comparison results indicates phase separation. If both comparison results indicate a phase separation (block 613), a phase separation condition is detected (block 614) and control proceeds to block 616 at which it is determined whether a relative amount of the phase separation is to be detected. If a relative amount of the phase separation is not to be detected (block 616), the process 600 ends. Otherwise, a third characteristic value of the fluid sample is measured (block 618). The third characteristic value is then compared to its corresponding reference value (block 620). The third comparison result is then used to determine the relative amount of the phase separation (e.g., a relative amount of gas separation from a liquid) (block 622) and the process 600 ends.

If, at block 613, the comparison results are inconsistent or conflicting with each other such that one comparison result indicates the presence of a phase separation and the other indicates the absence of the phase separation, the example process 600 detects an ambiguous phase separation result (block 624). Control then proceeds to block 618, at which a third characteristic value of the sample is measured and then compared (block 620) to its corresponding reference value. Then, at block 622, the third comparison result is used to resolve the ambiguous result detected at block 624.

As noted above, the general process 600 of FIGS. 6A and 6B together with the information provided in the example table 400 of FIG. 4 can be adapted to perform any desired phase separation detection more accurately and with less ambiguity. FIG. 7 is an example table 700 depicting a manner in which the example process 600 may be configured to detect a gas phase separating from a liquid phase (i.e., bubble point) of a fluid sample extracted from a subterranean formation. In accordance with the example table 700, the first characteristic value is selected to be scattering and the second characteristic value is selected to be acoustic impedance. The presence of a separating gas phase in a liquid may be manifested by the presence of bubbles and the presence of bubbles significantly increases optical scattering (e.g., attenuation) in a fluid sample and significantly decreases the acoustic impedance. The blocks labeled "change" are associated with a comparison result at block 608 of FIG. 6A indicative of the characteristic value being substantially different than its corresponding reference value. Conversely, the blocks labeled "No Change" are associated with a comparison result indicative of the characteristic value being substantially the same as its corresponding reference value. If neither of the comparison results indicates a phase separation (block 610 of FIG. 6A), then no gas separation is indicated at block 612 of FIG. 6A. If each of the comparison results indicates a phase separation (block 613 of FIG. 6A), then gas separation is indicated at block 614 of FIG. 6A and reflectance is measured to determine a relative amount of the separating gas phase (block 618). If the comparison result at block 620 indicates a change relative to the reference value for reflectance, then a relatively large amount of the separating gas phase is indicated as present, otherwise, if no change is identified for the comparison result at block 620, then a relatively small amount of the separating gas phase is indicated as present.

If one of the comparison results indicates no change and the other indicates a change, an ambiguous phase separation result is detected at block 624 of FIG. 6B. In the case where the comparison result associated with the scattering characteristic value indicates a change has occurred (i.e., indicates the presence of a separating gas phase) and the comparison result associated with the acoustic impedance indicates that no change has occurred (i.e., indicates the absence of a separating gas phase), the frequency response of the MEMS sensor 226 (FIG. 2) may be measured at block 618 of FIG. 6B to resolve the ambiguity.

Figure 10A:
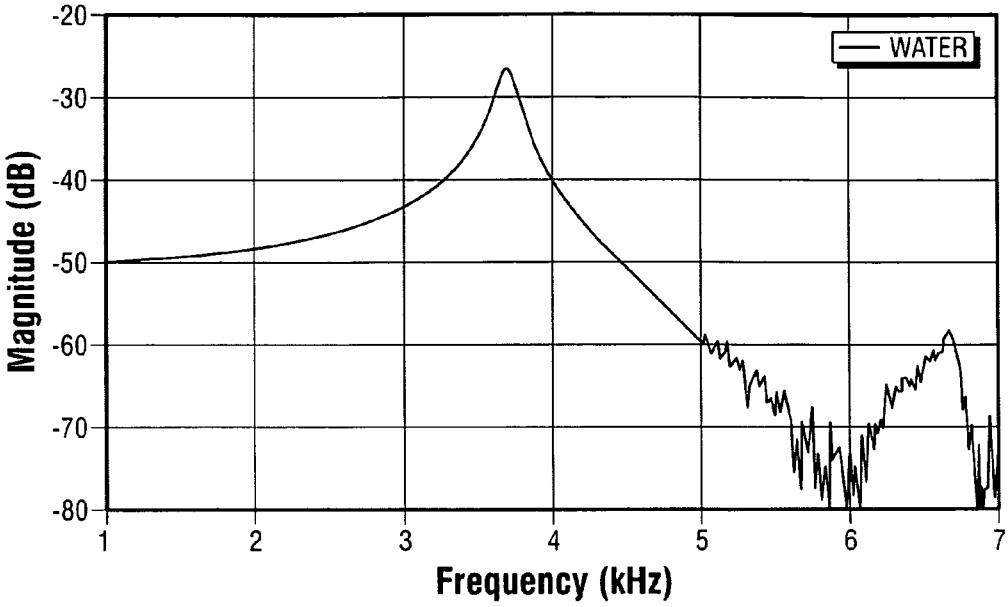
FIGS. 10A-D depict the frequency response of a micro electromechanical structure (MEMS) sensor according to one or more aspects of the present disclosure.
Figure 10B:
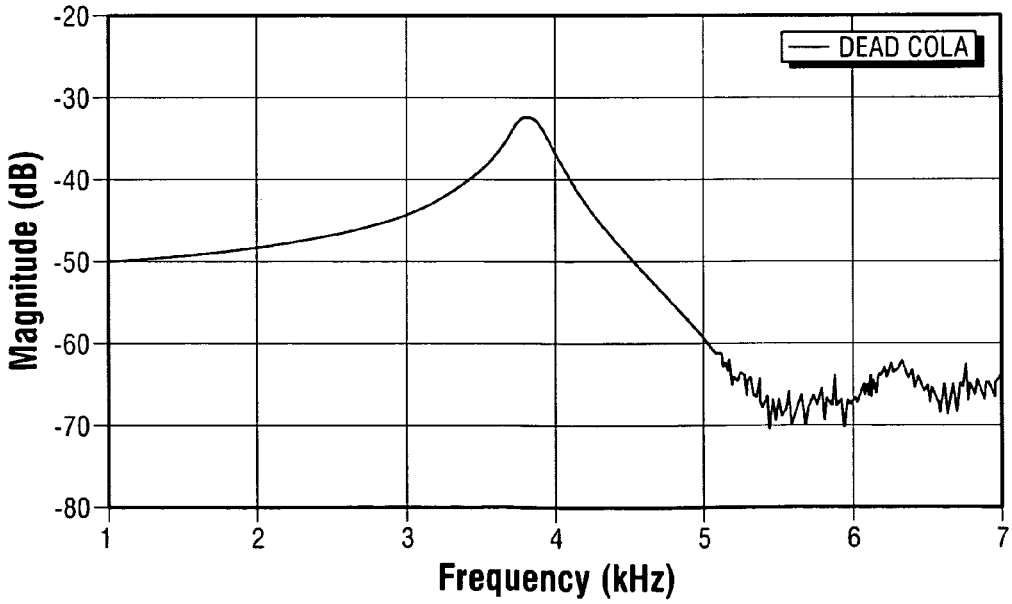
Figure 10C:
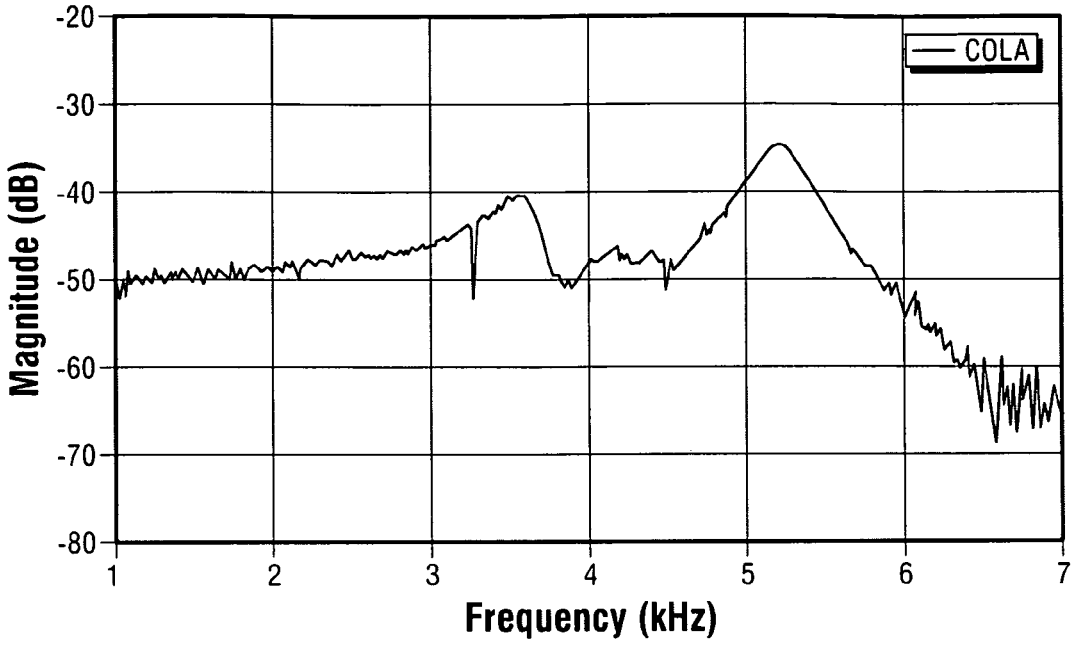
Figure 10D:
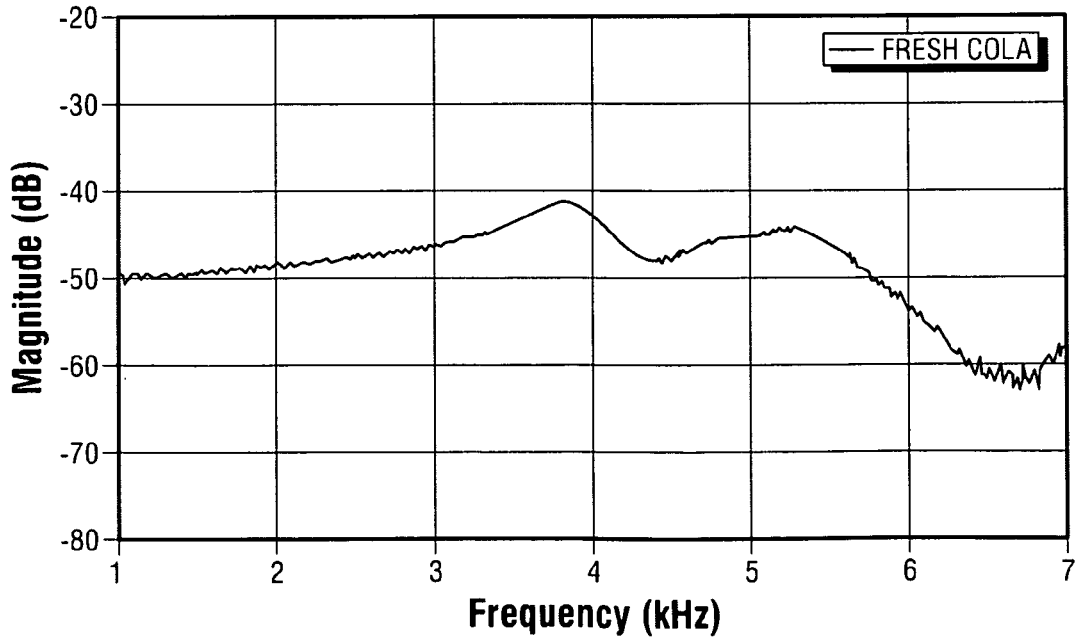

While a MEMS sensor (e.g., the MEMS sensor 226) is generally used to measure fluid density and/or viscosity, the frequency response of the flexible plate in the MEMS sensor is sensitive to the accumulation of gas bubbles on the plate. Specifically, gas bubbles sticking to the plate disturb the resonance mode(s) (and particularly the fundamental resonance mode) of the plate and, thus, can significantly affect the frequency response of the plate. Turning briefly to FIGS. 10A-D, the frequency response of a MEMS flexible plate is depicted in water (i.e., no gas bubbles) in FIG. 10A, dead cola (again, no gas bubbles) in FIG. 10B, cola (i.e., some gas bubbles) in FIG. 10C, and fresh cola (i.e., a relatively large amount of gas bubbles) in FIG. 10D. As can be seen in FIGS. 10C and 10D, the frequency response curve, particularly at frequencies surrounding the lower resonant frequency (i.e., the fundamental mode) is significantly affected by the presence of gas bubbles. More specifically, as can be seen in FIGS. 10C and 10D, the single, strong resonant frequency or characteristic at about 3.5 kHz-4 kHz, which is present in FIGS. 10A and 10B, becomes multiple weaker resonant frequencies or characteristics between about 3-5 kHz in the presence of bubbles. More generally, in the presence of a single-phase medium, the MEMS sensor provides a relatively strong resonant frequency peak at the fundamental mode. However, in the presence of bubbles, which tend to become non-uniformly distributed (i.e., a non-uniform mass distribution) on the MEMS sensor plate, the resonant mode of the plate becomes fragmented to cause the plate to exhibit multiple, weaker resonant modes. In any event, if the MEMS sensor indicates the presence of gas bubbles on the surface of its flexible plate, that result may be used to resolve the ambiguous result at block 622 of FIG. 6B.

Continuing with the foregoing example, the presence of mud solids can cause scattering and, thus, when the scattering characteristic indicates a change and the acoustic impedance indicates no change, it is possible that mud solid are present and causing the ambiguous phase separation result. Thus, if the MEMS sensor is used as described above, the ambiguity surrounding the presence or absence of gas bubbles (i.e., a separating gas phase) may be resolved. However, the presence of mud solids can additionally or alternatively be determined more conclusively. More specifically, a temporal pattern of the scattering characteristic values may be used to determine the presence of mud solids. In particular, because mud solids are relatively heavy or dense, they tend to settle very quickly once pumping of the sampling has stopped. Thus, by monitoring the scattering characteristic immediately after pumping of the sample is stopped, any temporal change in the scattering can be indentified. In the case where mud solids are present in the sample, the scattering characteristic values should exhibit a relatively rapid decrease immediately following the cessation of pumping activity.

An ambiguous phase separation result is also obtained when the scattering value yields a comparison result associated with no change (i.e., the absence of a separating gas phase) and the acoustic impedance yields a comparison result associated with change (i.e., the presence of a separating gas phase). In this case, a measurement error (e.g., an incorrect reference value) may have occurred and the frequency response of the MEMS sensor can be used as described above to resolve the ambiguity via blocks 618-622 of FIG. 6B. Alternatively or additionally, in the case of this ambiguous result scenario, the reflectance of the sample may be used to resolve the ambiguity. In other words, if a comparison result associated with a measured reflectance value indicates the presence of a separating gas phase, then the ambiguity may be resolved as the positive detection of a separating gas phase and a possible measurement error involving the scattering characteristic value (e.g., an incorrect reference value).

Figures 9, 11:
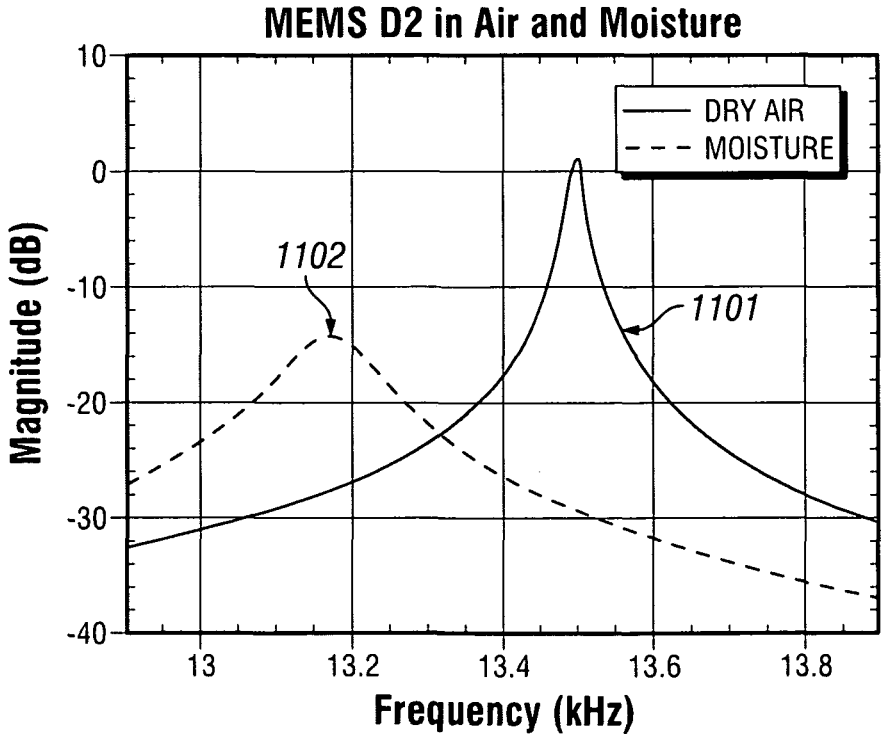
FIG. 9 is an example table according to one or more aspects of the present disclosure.
FIG. 11 depicts a downward shift in resonant frequency of a MEMS sensor according to one or more aspects of the present disclosure.

FIG. 8 is an example table 800 depicting an example a manner in which the example process 600 may be configured to detect a liquid phase separating from a gas phase (i.e., dew point) of a fluid sample extracted from a subterranean formation. In accordance with the example table 800, the first characteristic value is selected to be scattering and the second characteristic value is selected to be a frequency response of the MEMS sensor 226 (FIG. 2). The presence of a separating liquid phase in a gas may be manifested by the presence of droplets condensing on sensor surfaces and droplets suspended in the gas (e.g., a mist). Droplets suspended in a gas cause a significant change increase in the optical scattering (or attenuation) of the sample fluid and droplets condensing on the MEMS flexible plate increase the mass of the flexible plate and, thus, significantly decrease the resonant frequency of the MEMS sensor 226. Turning briefly to FIG. 11, the downward shift in resonant frequency of a MEMS sensor in response to droplets condensing on the flexible plate of the sensor is clearly shown. Curve or data 1101 corresponds to the dry air response, and curve or data 1102 corresponds to the response with moisture droplets having condensed on the plate of the sensor 226.

Returning to FIG. 8, if neither of the comparison results indicates a phase separation (block 610 of FIG. 6A) (i.e., the scattering characteristic value and the frequency response of the MEMS sensor are unchanged relative to their respective reference values), then no liquid separation is indicated at block 612 of FIG. 6A. On the other hand, if each of the comparison results indicates a phase separation (block 613 of FIG. 6A), then liquid separation is indicated at block 614 of FIG. 6A and fluorescence is measured to determine a relative amount of the separating liquid phase (block 618). Accumulation of droplets on the window associated with the fluorescence/reflectance sensor 216 (FIG. 2) tends to increase the fluorescence and reflectance characteristic values. Thus, if the comparison result at block 620 indicates a change relative to the reference value for fluorescence, then a relatively large amount of the separating liquid phase is indicated as present, otherwise, if no change is identified for the comparison result at block 620, then a relatively small amount of the separating liquid phase (e.g., a mist) is indicated as present.

If one of the comparison results indicates no change and the other indicates a change, an ambiguous phase separation result is detected at block 624 of FIG. 6B. In the case where the comparison result associated with the scattering characteristic value indicates a change has occurred (i.e., indicates the presence of a separating gas phase) and the comparison result associated with the MEMS frequency response indicates that no change has occurred (i.e., indicates the absence of a separating liquid phase), the possible presence of mud solids is indicated and/or a measurement error has occurred (e.g., a incorrect reference value). The ambiguity may be resolved at blocks 618-622 by measuring one or both of the fluorescence and reflectance characteristic values. Additionally or alternatively, the presence of mud solids can be confirmed based on the temporal characteristics of the scattering characteristic values as described above.

In the other ambiguous phase separation result where the scattering characteristic value indicates no change relative to its reference value and the frequency response of the MEMS sensor indicates a change relative to its reference frequency response, a possible measurement error may be indicated. Again, this ambiguous result may be resolved at blocks 618-622 using one or both of the fluorescence and reflectance characteristic values.

FIG. 9 is an example table 900 depicting an example a manner in which the example process 600 may be configured to detect a solid phase separating from a liquid phase (e.g., asphaltene precipitation) of a fluid sample extracted from a subterranean formation. Asphaltenes are heavy components of crude (black) oils and their precipitation is induced by a drop in temperature and/or pressure. Asphaltenes are opaque and, thus, when they precipitate in a fluid they increase the optical density (attenuation) measured by all channels of a spectrometer (e.g., the spectrometer 222 of FIG. 2. Thus, in accordance with the example table 900, the first characteristic value is selected to be scattering and the second characteristic value is selected to be a temporal pattern of the scattering characteristic values. The scattering characteristic value may be obtained by monitoring an optical density channel of the spectrometer 222 (FIG. 2) associated with a wavelength of between about 1550 nm and 1600 nm. At these wavelengths, the scattering or attenuation due to single-phase crude oil, for example, is minimal and, thus, the presence of any solids (e.g., asphaltene precipitate) can be readily detected at these wavelengths. However, solids such as mud solids also result in a significant increase in scattering or attenuation. Thus, using the temporal pattern of the scattering characteristic values as a second characteristic value enables further discrimination between mud solids and other solids such as asphaltene precipitate. As noted above, mud solids tend to settle rapidly following the cessation of pumping, whereas asphaltene precipitate tends to remain suspended for a relatively long time following the cessation of pumping. Thus, if the temporal pattern of the scattering characteristic exhibits a scattering or attenuation that decreases relatively quickly after pumping ceases, then mud solids rather than asphaltene precipitate is indicated. Conversely, if the temporal pattern of the scattering characteristic exhibits a scattering or attenuation that decreases relatively slowly after pumping ceases, then asphaltene precipitate is indicated.

As indicated in the example table 900, the backscattering characteristic may used in addition to or as an alternative to the temporal pattern of the scattering characteristic values. As described above, the backscattering sensor 224 can be used to sense the intensity difference in backscattering resulting from the color contrast of a fluid sample. Thus, the intensity of the signal provided by the backscattering signal is indicative of the color (e.g., grayscale) of the fluid sample. Asphaltenes are relatively dark (e.g., black in color), whereas mud solids are relatively lighter (e.g., gray in color). Thus, a backscattering characteristic value corresponding to a relatively dark solid in the fluid is indicative of the presence of an asphaltene precipitate in the sample.

As shown in the example table 900 of FIG. 9, if the scattering comparison result and temporal pattern of the scattering characteristics both indicate no change (i.e., the absence of a separating solid phase) at block 610 of FIG. 6A, then no separating solid phase is indicated at block 612. Conversely, if the scattering comparison result and the temporal pattern of the scattering characteristics both indicate change (i.e., the presence of a separating solid phase such as asphaltene precipitation) at block 613 of FIG. 6A, then a separating solid phase (e.g., asphaltene precipitation) is indicated at block 614 of FIG. 6A. In the case where the scattering characteristic comparison result indicates a change and the temporal pattern of the scattering characteristic values indicate no change, an ambiguous phase separation result is indicated at block 624 of FIG. 6B. This ambiguous result may be indicative of the possible presence of mud solids or gas bubbles. The backscattering characteristic may be used at blocks 618-622 to resolve the ambiguity. In the other ambiguous result scenario where the scattering characteristic comparison result indicates no change and the temporal pattern of the scattering characteristic values indicates change, the ambiguity is resolved to indicate no separating solid phase.

As shown in the example table 900 of FIG. 9, if the backscattering characteristic is used instead of or in addition to the temporal pattern of the scattering characteristic values, a no change condition corresponds to the presence of the separating solid phase (e.g., asphaltene precipitation) and a change condition corresponds to the presence of mud solids rather than a separating solid phase.

The foregoing techniques to detect phase separations in downhole fluid samples rely, at least in part, on the use of the spectrometer 222 (FIG. 2) to measure scattering (or attenuation) at one or more wavelengths. As noted above, the scattering characteristic of a fluid sample is a strong indicator of the uniformity (or non-uniformity) of a fluid and phase separations in fluids significantly increase the degree of non-uniformity in a fluid sample. Further, as described above, the foregoing techniques use comparisons between scattering characteristic values associated with a known single-phase condition (i.e., reference values) of the fluid sample and scattering characteristic values measured during a phase separation detection process to identify possible phase separation(s). Thus, it is important to ensure that the optical density (i.e., attenuation) values obtained using the spectrometer are accurate (e.g., are not offset or otherwise in error) to ensure accurate detection of phase separations. More generally, spectrometers (such as the spectrometer 222) are used to perform a wide variety of downhole fluid analyses (e.g., compositional analyses) that provide results that can have a significant impact on drilling decisions, production decisions, etc. that, in turn, can have a significant impact on the economics of producing hydrocarbon fluid(s) from a well.

Techniques to identify one or more inaccurate optical density channels of a spectrometer are described in detail below. Generally, these techniques use the spectrometer (e.g., the spectrometer 222 of FIG. 2) being tested to measure the composition of a formation fluid at multiple different pressures and/or at different times during sample clean up. The multiple composition measurements are then analyzed to determine the manner, if any, in which the composition varies. In the case of composition measurements made at different pressures, any channel(s) that appear to provide substantially invariant optical density values are indicated as possibly inaccurate (e.g., having an offset). On the other hand, in the case of composition measurements made at different times during sample cleanup and, thus, at different levels of sample contamination, any channel(s) providing optical density values that do not vary in proportion with other optical density channels are indicated as possibly inaccurate.

Figure 12:
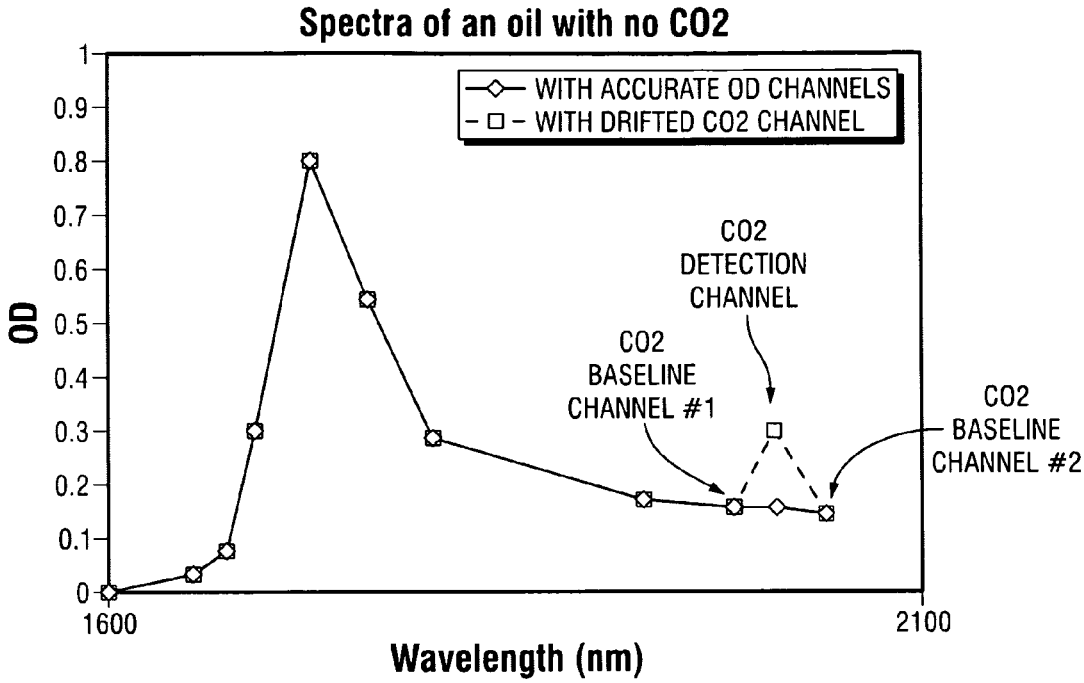
FIG. 12 depicts spectra of an oil according to one or more aspects of the present disclosure.

Turning to FIG. 12, spectra of an oil are shown for one condition in which a CO2 detection channel is accurate and another condition in which the CO2 detection channel has drifted significantly resulting in inaccurate optical density value measurements. The oil being measured actually contains no CO2. However, in the case where the CO2 detection channel is drifted upward (i.e., to a higher optical density), a composition measurement of the oil yields at 25 wt % CO2 component, despite the fact that the oil actually contains no CO2. Further, when computing the composition of downhole fluids, the proportion of each fluid component in the fluid is typically computed using multiple optical density channels. Thus, one channel in error can impact the accuracy with which multiple fluid component concentrations are computed.

Figure 13:
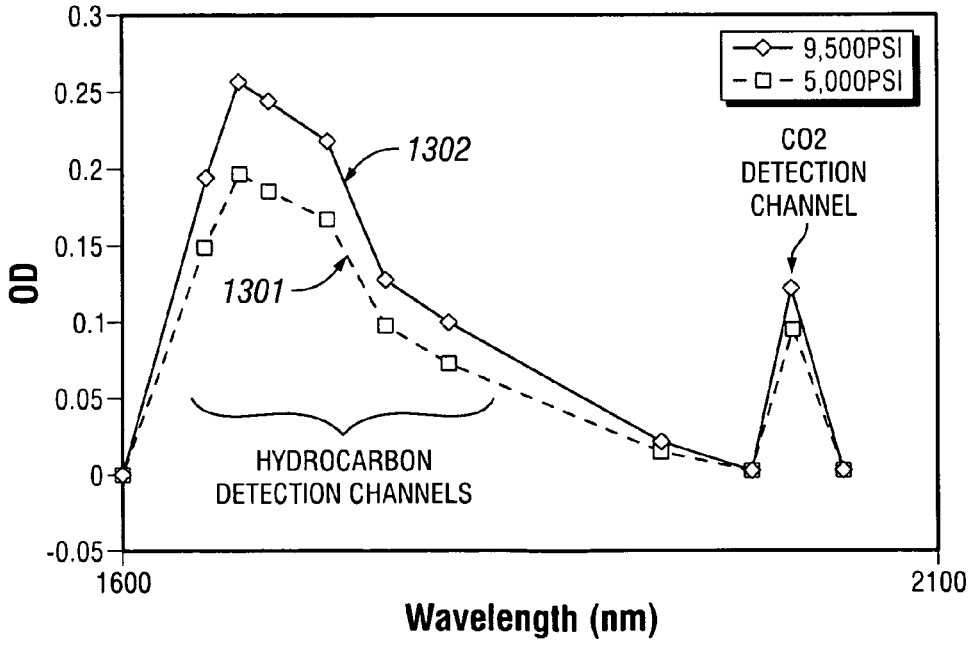
FIG. 13 depicts spectra of an oil according to one or more aspects of the present disclosure.

FIG. 13 depicts spectra of an oil at two different pressures (i.e., 5,000 psi and 9,500 psi) as determined by a spectrometer having no inaccurate optical density channels. Curve or data 1301 corresponds to the relatively lower pressure (i.e., 5000 psi) and curve or data 1302 corresponds to the relatively higher pressure (i.e., 9,500 psi). As can be seen, except for the baseline channels, the change in optical density values over pressure is proportional across the channels. As a result, the fluid composition, when expressed as weight percentages of the components, is substantially constant over the different pressures. As long as the fluid being analyzed is single phase (e.g., the pressure is maintained above the saturation pressure of the components of the fluid), variations in pressure (and temperature) will not substantially affect the fluid composition and an accurate spectrometer will provide optical density values that vary relative to each other to maintain a substantially constant weight percentage for each of the components of the fluid sample.

Figures 14, 15, 16:
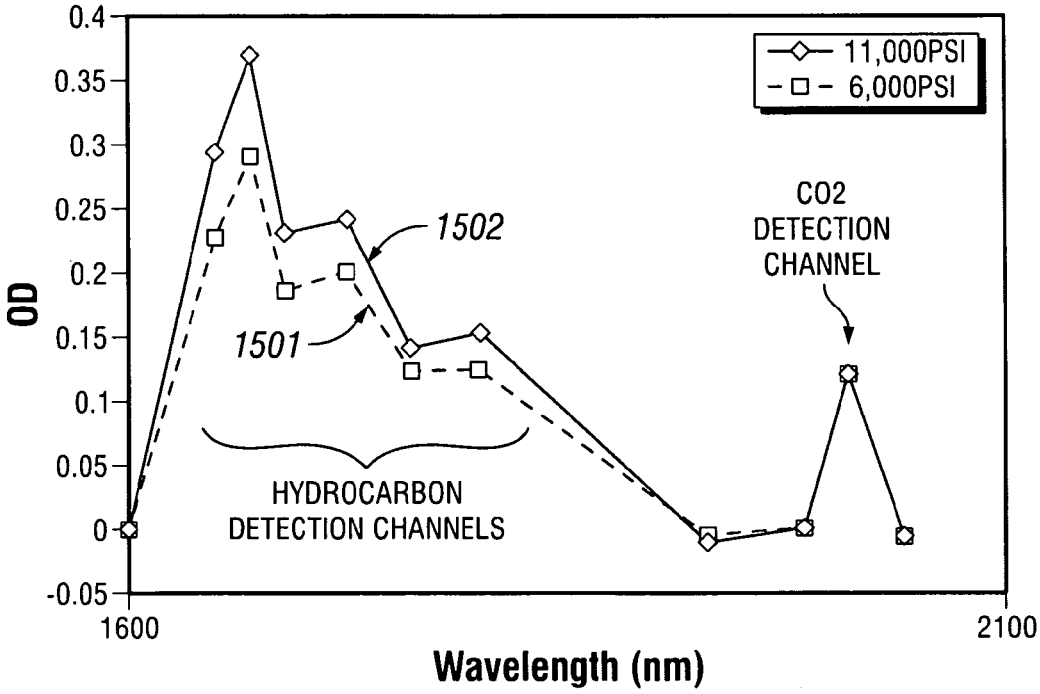
FIG. 14 is an example table according to one or more aspects of the present disclosure.
FIG. 15 depicts spectra of an oil according to one or more aspects of the present disclosure.
FIG. 16 is an example table according to one or more aspects of the present disclosure.

FIG. 14 is a table providing the weight percentages for the various hydrocarbon and CO2 components of the fluid analyzed in FIG. 13 at the different pressures. As can be seen in the table of FIG. 14, the computed weight percentages of the various components remains substantially constant (i.e., some minimal variation may occur) over a pressure range of 5,000 psi to 9,500 psi.

FIG. 15 depicts spectra of an oil as measured by a spectrometer having an inaccurate optical density channel at a wavelength associated with CO2 detection. The spectra represent optical densities for various channels at 6,000 psi (curve or data 1501) and 11,000 psi (curve or data 1502). As can be seen in FIG. 15, the optical density values at the inaccurate channel associated with CO2 detection do not substantially change, while the other non-baseline channels vary proportionally with the pressure change. As a result, using the spectra of FIG. 15 to determine the composition of the fluid being analyzed results in an error because the weight percentage of CO2 computed varies significantly with pressure (because the optical density value is not changing with pressure). FIG. 16 is a table providing the computed weight percentages of the various components of the fluid analyzed in FIG. 15. As can be seen in FIG. 16, the weight percentage of CO2, which does not actually vary, is computed to vary about 6% due to the inaccurate optical density channel.

Figure 17:
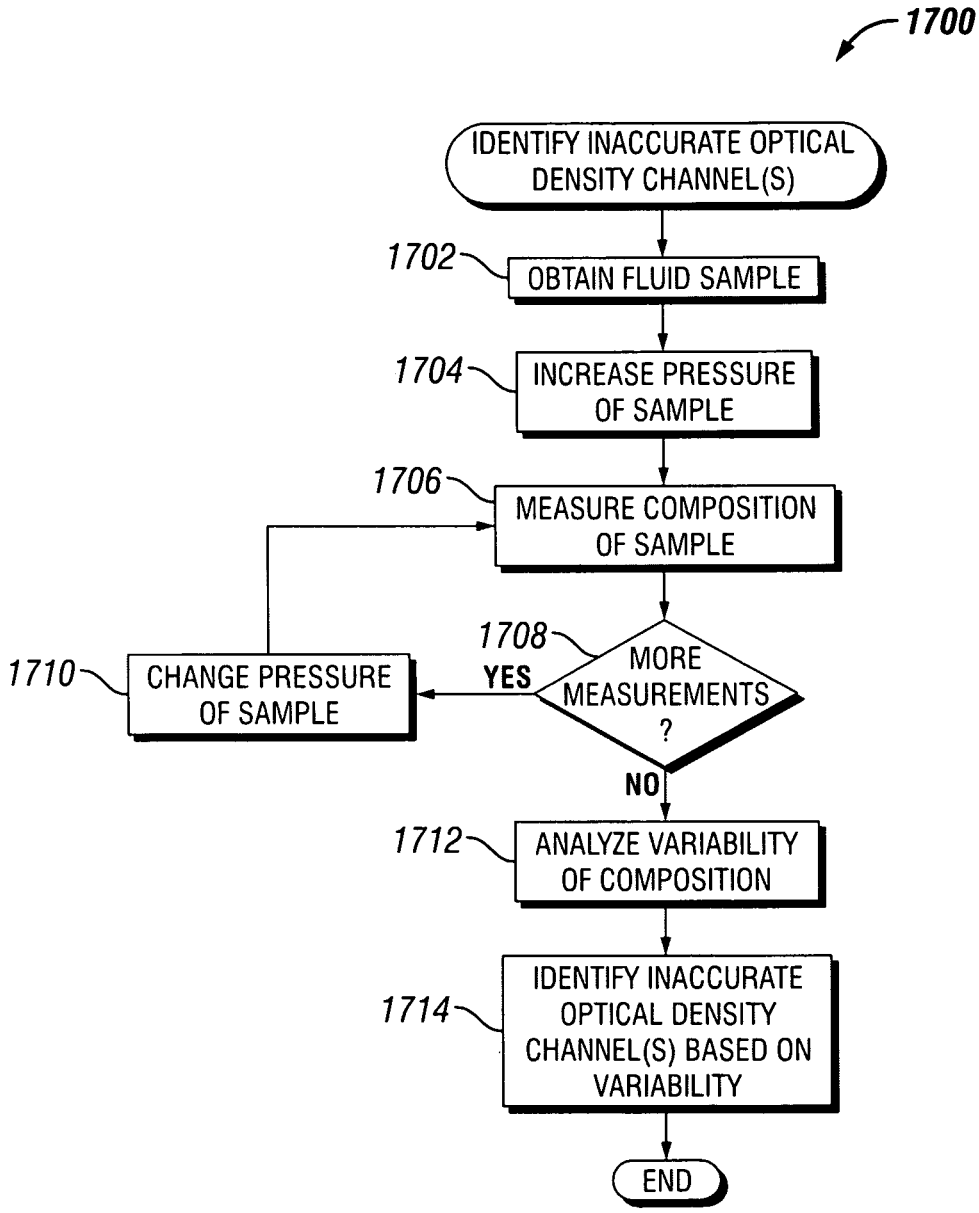
FIG. 17 generally illustrates a process according to one or more aspects of the present disclosure.

FIG. 17 generally illustrates a process 1700 that may be used to detect one or more inaccurate optical density channels of a spectrometer by identifying those channels that provide optical density values that do not vary in a proportional manner over pressure changes (e.g., channels that provide a substantially constant optical density values for a wide range of pressures). Initially, a sample of fluid is obtained (block 1702) and the pressure of the sample is maintained to be above the saturation pressure of the components of the fluid (block 1704). When using the example fluid analyzer 200 (FIG. 2), a sample of fluid may be collected and the pump unit 218 may be used to increase the pressure of the sample. The composition of the sample is then measured (e.g., using the spectrometer 222 of FIG. 2) (block 1706) and the process 1700 determines whether more measurements are to be made (block 1708). For example, a predetermined number of measurements may be made (e.g., 2, 3, 4, etc.). If more measurements are to be made (block 1708), then the pressure of the sample is changed (e.g., increased) (block 1710) and the composition of the sample is again measured (block 1706). On the other hand, if no more measurements are to be made (block 1708), the variability of the composition measurements is analyzed (block 1712). For example the maximum change in the weight percentage of each of the components may be determined and stored. Then, the process 1700 identifies as potentially inaccurate those optical density channels for which a relatively large change in the weight percentage of a component was computed at block 1712 (block 1714). In some cases, one or more optical density channels identified as inaccurate may be ignored when computing the weight percentages of the other components of the fluid to provide a potentially more accurate compositional analysis of the fluid.

Figure 18:
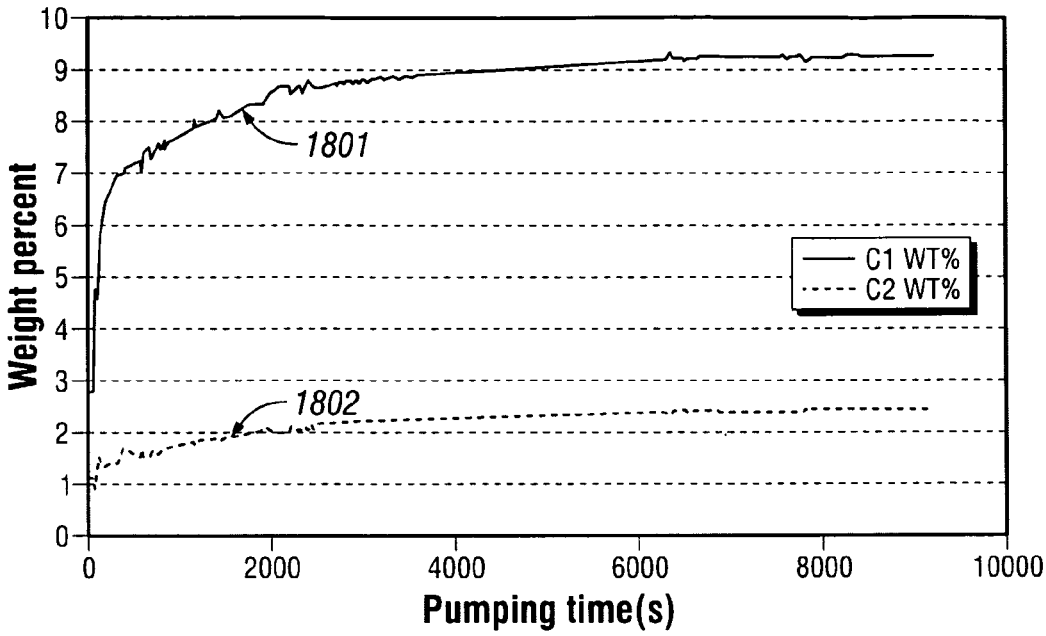
FIG. 18 depicts the gradual increase in the weight percentages of C1 and C2 over time according to one or more aspects of the present disclosure.

Another technique to identify inaccurate channels of a spectrometer is provided in connection with FIGS. 18-20 below. This additional technique recognizes that when fluid is first pumped out of a formation during a sampling operation, some amount of invaded mud filtrate (i.e., contamination) is also present in the fluid sample. This type of contamination can be particularly problematic when an oil-based mud (OBM) is used, because the presence of OBM and/or OBM filtrate in a fluid sample can significantly reduce the accuracy of laboratory analyses of the fluid sample. As a result, most sampling operations pump fluid for a relatively long period of time to clean up the extracted fluid (i.e., reduce contamination to an acceptable level) before capturing or collecting a sample for analysis. Thus, during the sampling process, the level of contamination decreases and the concentration of pristine fluid components that do not exist in the OBM contamination (e.g., C1 and C2, and, in some cases, CO2) increases. FIG. 18 depicts the gradual increase in the weight percentages of C1 (curve or data 1801) and C2 (curve or data 1802) over time (i.e., during pumping to clean up the fluid to be sampled) as measured by a spectrometer having no inaccurate optical density channels.

Figure 19:
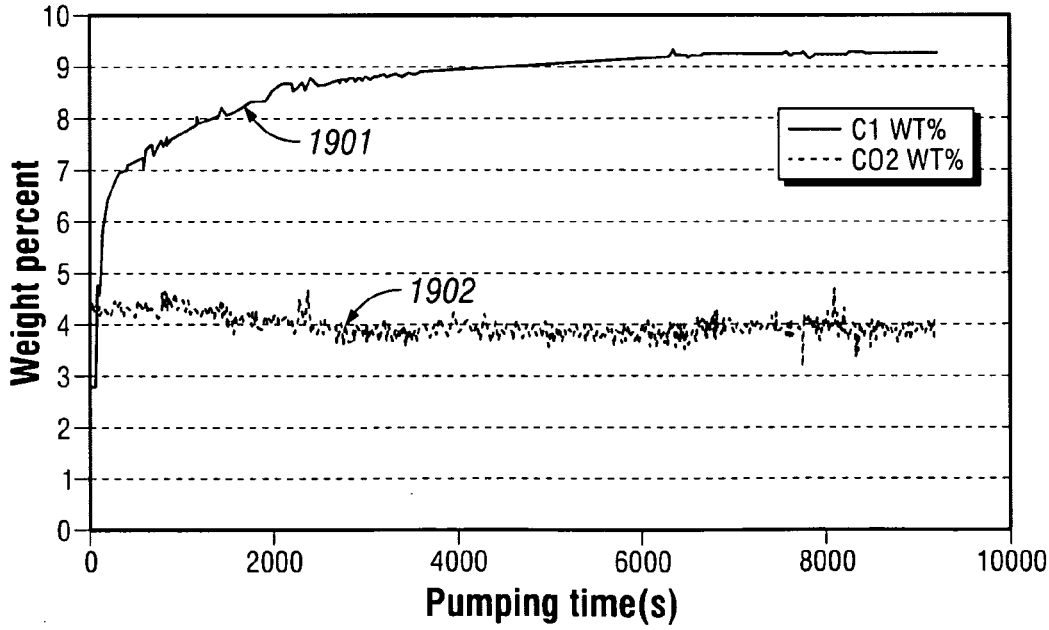
FIG. 19 depicts the weight percentages of CO2 and C1 during a cleanup operation according to one or more aspects of the present disclosure.

FIG. 19 depicts the weight percentages of CO2 (curve or data 1902) and C1 (curve or data 1901) during a cleanup operation as measured by a spectrometer having an inaccurate optical density channel associated with CO2 detection. As can be seen in FIG. 19, the weight percentage of CO2 is unreasonably high (about 4.5 wt %) at the outset and remains substantially constant throughout the pumping process. In contrast, the optical density channel(s) associated with detecting C1 is/are accurate and, thus, the weight percentage of C1 appears to increase with time as expected. Inaccurate optical density channels can therefore be identified during a sample clean up operation by identifying components having an unreasonably high weight percentage at the outset and/or components exhibiting a weight percentage that does not substantially vary during the pumping process.

Figure 20:
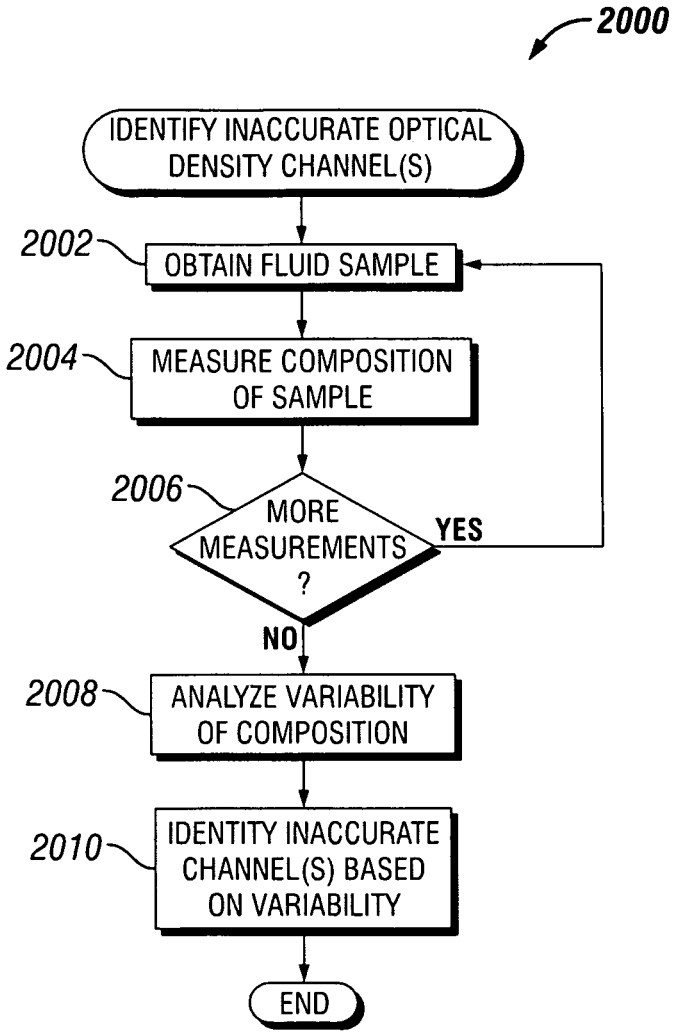
FIG. 20 generally illustrates a process according to one or more aspects of the present disclosure.

FIG. 20 generally illustrates a process 2000 that may be used to detect one or more inaccurate optical density channels of a spectrometer by identifying those channels that provide composition values that do not vary reliably over time (e.g., channels that provide a substantially constant C1 and/or CO2 composition value over time) during a sample clean up process. Initially, a sample of fluid is obtained (block 2002) and the composition of the sample is then measured (e.g., using the spectrometer 222 of FIG. 2) (block 2004). The process 2000 then determines whether more measurements are to be made (block 2006). For example, a predetermined number of measurements may be made (e.g., 2, 3, 4, etc.) or measurements may be made for a predetermined amount of time. If more measurements are to be made (block 2006), then the process continues to obtain sample fluid (block 2002) and the composition of the sample is again measured (block 2004). On the other hand, if no more measurements are to be made (block 2006), the variability of the composition measurements is analyzed (block 2008). For example the change in the weight percentage of each of the components may be compared to each other. Then, the process 2000 identifies as potentially inaccurate those optical density channels which exhibit an unreasonably high weight percentage at the outset of pumping, exhibit a weight percentage that remains substantially constant throughout the pumping process, and/or which exhibit a weight percentage that does not vary over time during the pumping process in a manner that is consistent with the other channels (block 2010). In some cases, one or more optical density channels identified as inaccurate may be ignored when computing the weight percentages of the other components of the fluid to provide a potentially more accurate compositional analysis of the fluid.

The example processes describe herein may be carried out by a processor, a controller and/or any other suitable processing device. For example, the example processes described herein may be embodied in coded instructions stored on a tangible medium such as a flash memory, a read-only memory (ROM) and/or random-access memory (RAM) associated with a processor (e.g., the example processor P105 discussed below in connection with FIG. 21). Alternatively, some or all of the example processes described herein may be implemented using any combination(s) of circuit(s), ASIC(s), PLD(s), FPLD(s), discrete logic, hardware, firmware, etc. Also, one or more of the operations of the example processes described herein may be implemented manually or as any combination of any of the foregoing techniques, for example, any combination of firmware, software, discrete logic and/or hardware. Further, although the example operations of the example processes are described with reference to the flowcharts, many other methods of implementing the operations of these processes may be employed. For example, the order of execution of the blocks may be changed, and/or one or more of the blocks described may be changed, eliminated, sub-divided, or combined. Additionally, any or all of the example processes described herein may be carried out sequentially and/or carried out in parallel by, for example, separate processing threads, processors, devices, discrete logic, circuits, etc.

Figure 21:
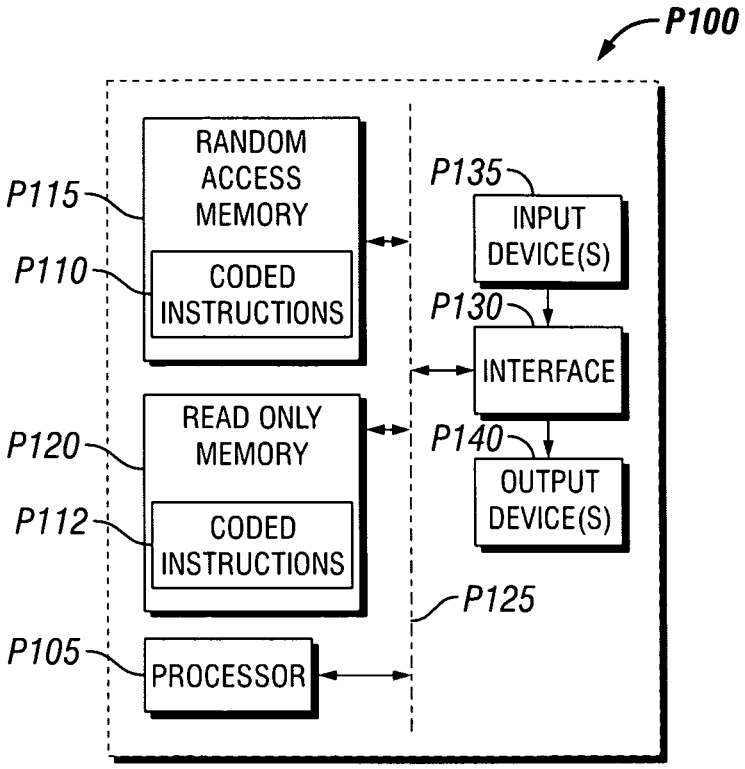
FIG. 21 is a schematic illustration of an example processor platform that may be used and/or programmed to implement the example methods and apparatus described herein.

FIG. 21 is a schematic diagram of an example processor platform P100 that may be used and/or programmed to implement all or a portion of any or all of the example processing units or modules described herein. The processor platform P100 of the example of FIG. 21 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes described herein or, more generally, to implement the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130.

Figure 22:
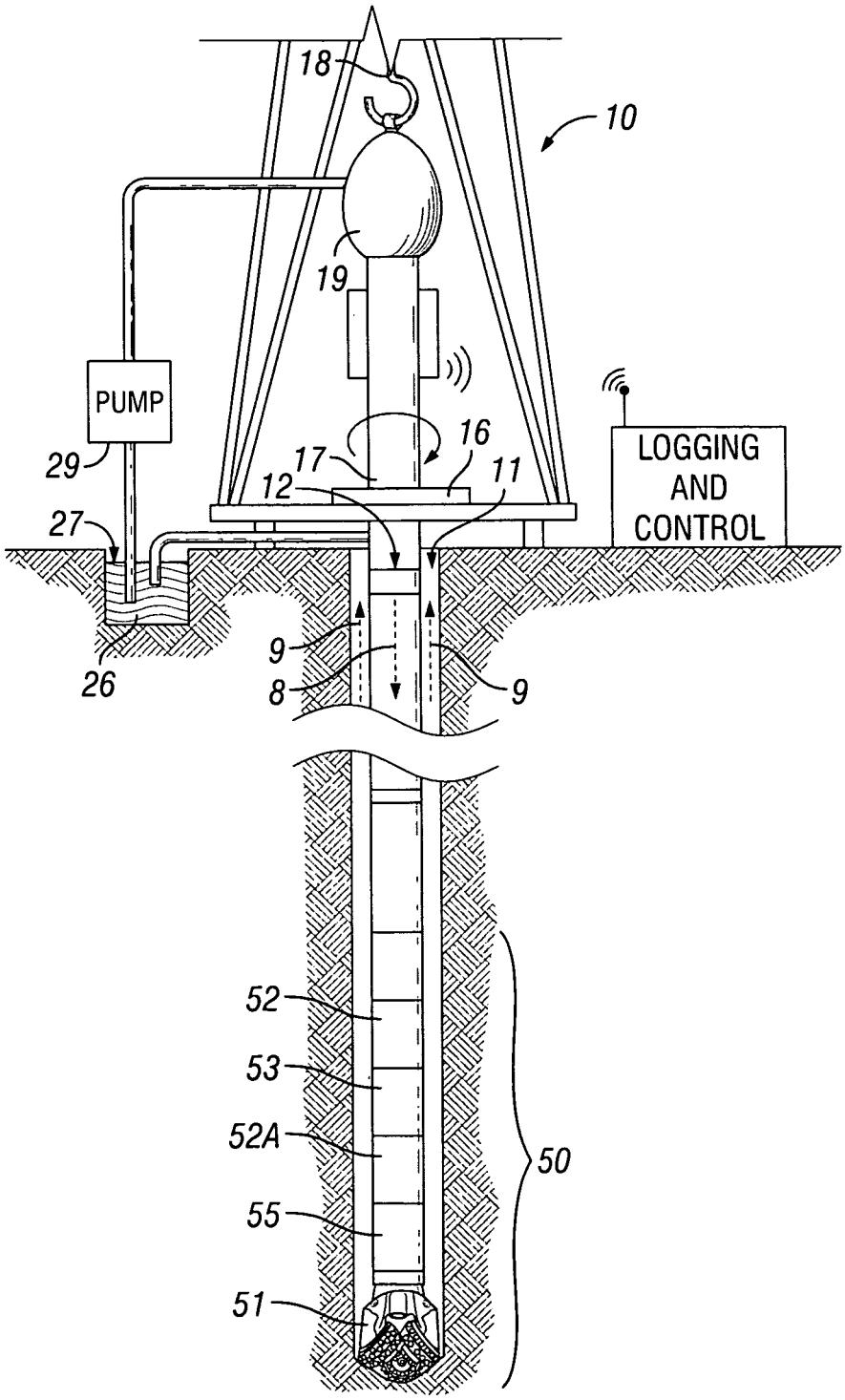
FIG. 22 depicts an example while-drilling tool that may be used to extract and analyze formation fluid samples according to one or more aspects of the present disclosure.

FIG. 22 illustrates a wellsite system in which one or more aspects of the present disclosure may be employed. The wellsite can be onshore or offshore. In this exemplary system, a borehole 11 is formed in subsurface formations by rotary drilling in a manner that is well known. Embodiments of the present disclosure can also use directional drilling.

A drill string 12 is suspended within the borehole 11 and has a bottom hole assembly 50 which includes a drill bit 51 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 51, and then circulates upwardly through the annulus region between the outside of the drill string and the wall of the borehole, as indicated by the directional arrows 9. In this well known manner, the drilling fluid lubricates the drill bit 51 and carries formation cuttings up to the surface as it is returned to the pit 27 for recirculation.

The bottom hole assembly 50 of the illustrated embodiment comprises a logging-while-drilling (LWD) module 52, a measuring-while-drilling (MWD) module 53, a roto-steerable system and motor, and the drill bit 51. The LWD module 52 and/or the MWD module 53 may be or comprise a tool that may be used to extract and analyze formation fluid samples in accordance with the example methods and apparatus described herein. For example, the LWD module 52 and/or the MWD module 53 may include or be communicatively coupled to a reference database that may be used to store reference measurement values of reference formation fluids known to have particular fluid compositions, densities, and any other parameters or characteristics. The LWD module 52 and/or the MWD module 53 may further comprise a downhole control system and/or otherwise be configured to control extraction of formation fluid from a formation F, perform measurements on the extracted fluid, and to control the apparatus described herein to determine a phase separation condition of the extracted formation fluid.

The LWD module 52 is housed in a special type of drill collar, as is known in the art, and can contain one or a plurality of known types of logging tools. It will also be understood that more than one LWD and/or MWD module can be employed, e.g. as represented at 52A. (References, throughout, to a module at the position of 52 can alternatively mean a module at the position of 52A as well.) The LWD module includes capabilities for measuring, processing, and storing information, as well as for communicating with the surface equipment. In the present embodiment, the LWD module includes a fluid sampling device.

The MWD module 53 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

Figure 23:
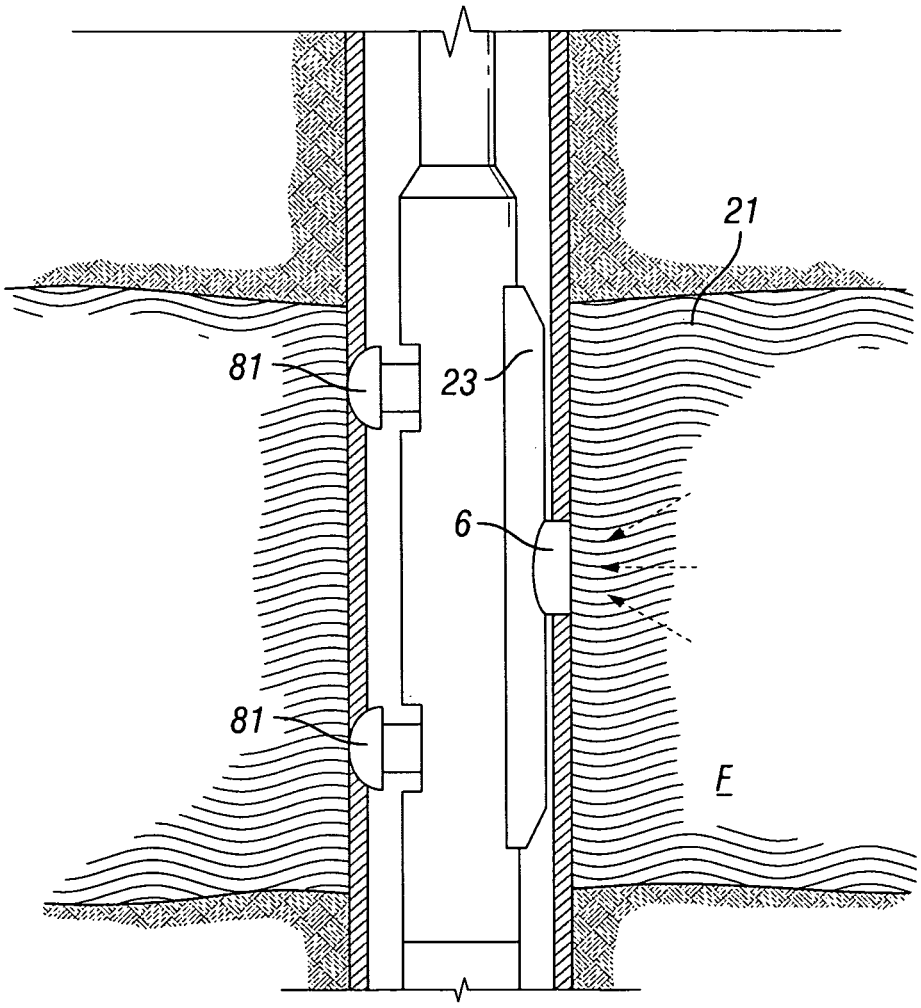
FIG. 23 depicts a portion of the while-drilling tool shown in FIG. 22.

FIG. 23 is a simplified diagram of a sampling-while-drilling logging device of a type described in U.S. Pat. No. 7,114,562, incorporated herein by reference, utilized as the LWD tool 52 or part of an LWD tool suite 52A. The LWD tool 52 is provided with a probe 6 for establishing fluid communication with the formation and drawing the fluid 21 into the tool, as indicated by the arrows. The probe may be positioned in a stabilizer blade 23 of the LWD tool and extended therefrom to engage the borehole wall. The stabilizer blade 23 comprises one or more blades that are in contact with the borehole wall. Fluid drawn into the downhole tool using the probe 26 may be measured to determine, for example, pretest and/or pressure parameters. Additionally, the LWD tool 52 may be provided with devices, such as sample chambers, for collecting fluid samples for retrieval at the surface. Backup pistons 81 may also be provided to assist in applying force to push the drilling tool and/or probe against the borehole wall.

The example while-drilling tools shown in FIGS. 22 and 23 may be used in conjunction with the example methods and apparatus described herein to determine a phase separation condition of a formation fluid sample. For example, the LWD module 52 and/or the MWD module 53 may include one or more sensors, fluid analyzers and/or fluid measurement units disposed adjacent a flowline and may be controlled by one or both of a downhole control system and a surface-located electronics and processing system to determine the composition of as well as other characteristics of fluid samples extracted from, for example, the formation F. More specifically, the LWD module 52 and/or the MWD module 53 may be configured to extract fluid samples from the formation F and to determine, based on comparisons of measured characteristic values and corresponding reference characteristic values associated with a substantially single-phase condition of the extracted fluid type and/or a measured variability of a composition of the sample, whether the extracted sample is substantially single phase or whether the sample exhibits a phase separation such as a gas separating from a liquid, a liquid separating from a gas, or a solid separating from a liquid using the example techniques described herein. Further, the LWD module 52 and/or the MWD module 53 may be configured to identify one or more inaccurate optical density channels of a fluid analyzer (e.g., a fluid analyzer 200 of FIG. 2) in the LWD module 52 and/or the MWD module 53 based on the variability of a composition of the extracted fluid sample for a plurality of pressures and/or for a range of different contamination levels (e.g., as an oil-based mud concentration in the extracted fluid changes during a sampling process). One or more other aspects of the LWD module 52 and/or the MWD module 53 may be as described above with reference to the wireline tool 100 shown in FIG. 1 and/or the fluid analyzer 200.

In view of the foregoing description and the figures, it should be clear that the present disclosure introduces a method of detecting a phase separation condition of a fluid from a subterranean formation, where the method may obtain a sample of the fluid and may measure a first characteristic value of the sample and a second characteristic value of the sample. The method may also compare the first characteristic value to a first reference value associated with a single-phase condition of the fluid to generate a corresponding first comparison result and may compare the second characteristic value to a second reference value associated with the single-phase condition of the fluid to generate a corresponding second comparison result. The method may then detect the phase separation condition of the fluid based on the first and second comparison results.

The present disclosure also introduces a method of detecting a phase separation condition of a fluid from a subterranean formation where the method may obtain a sample of the fluid and may measure a composition of the sample at a plurality of pressures. The method may detect the phase separation condition of the fluid based on the variability of the composition for the plurality of pressures.

The present disclosure also introduces a method of identifying an inaccurate optical density measurement for use with a downhole fluid analyzer where the method may obtain a sample of a fluid in the fluid analyzer and may measure a composition of the sample at a plurality of times. The method may identify an inaccurate optical density measurement based on the variability of the composition for the plurality of times.

The present disclosure also introduces a method comprising obtaining a sample of a fluid, measuring a first characteristic value of the sample, measuring a second characteristic value of the sample, comparing the first characteristic value to a first reference value associated with a single-phase condition of the fluid to generate a corresponding first comparison result, comparing the second characteristic value to a second reference value associated with the single-phase condition of the fluid to generate a corresponding second comparison result, and detecting the phase separation condition of the fluid based on the first and second comparison results. The method may further comprise generating an output indicative of the phase separation condition. The method may further comprise presenting the output to a person performing a sampling operation at a wellbore penetrating the subterranean formation. Presenting the output to the person may comprise at least one of displaying or printing the output. Detecting the phase separation condition of the fluid may comprises: detecting a phase separation of the fluid if each of the first and second comparison results indicates the presence of the phase separation; detecting substantially no phase separation of the fluid if neither of the first and second comparison results indicates the presence of the phase separation; and detecting an ambiguous phase separation result if one of the first and second comparison results indicates the presence of the phase separation and the other one of the first and second comparison results indicates the absence of the phase separation condition.

The method may further comprise: measuring a third characteristic value of the sample; comparing the third characteristic value to a third reference value associated with the single-phase condition of the fluid to generate a third comparison result; and using the third comparison result to detect the phase separation condition of the fluid if the first and second comparison results provide the ambiguous phase separation result. The presence of the phase separation may be indicated by any one of the comparison results when the characteristic value corresponding to that comparison result is substantially different than the reference value corresponding to that comparison result. The absence of the phase separation may be indicated by any one of the comparison results when the characteristic value corresponding to that comparison result is substantially the same as the reference value corresponding to that comparison result. Measuring the first characteristic value may comprise measuring an optical scattering characteristic of the sample. Measuring the second characteristic value may comprise measuring one of an acoustic impedance, a resonant frequency of a micro electromechanical systems (MEMS) sensor, a temporal characteristic of the optical scattering characteristic, or a backscattering characteristic. Detecting the phase separation condition of the fluid may comprise detecting a gas separating from a liquid, a liquid separating from a gas, or a solid separating from a liquid. Detecting the gas separating from the liquid may comprise measuring the acoustic impedance and indicating the presence of the gas if the each of the first and second comparison results indicates the presence of the phase separation.

The method may further comprise measuring a reflectance value of the sample and indicating a relative amount of the gas based on the reflectance value. The method may further comprise indicating the absence of the gas if neither of the first and second comparison results indicates the presence of the phase separation. The method may further comprise indicating the presence of mud solids if the first comparison result indicates the presence of the phase separation and the second comparison result indicates the absence of the phase separation. The method may further comprise using at least one of the resonant frequency of the MEMS sensor or the temporal characteristic of the optical scattering characteristic to indicate the presence of the mud solids or the absence of the gas. The method may further comprise indicating a measurement error if the first comparison result indicates the absence of the gas and the second comparison result indicates the presence of the gas. The measurement error may be associated with at least one of the reference values being in error. The method may further comprise using the resonant frequency of the MEMS sensor to indicate the presence or the absence of the gas.

Detecting the liquid separating from the gas may comprise measuring the resonant frequency of the MEMS sensor and indicating the presence of the liquid if each of the first and second comparison results indicates the presence of the phase separation. The method may further comprise measuring a fluorescence value of the sample and indicating a relative amount of the liquid based on the fluorescence value. The method may further comprise indicating the absence of the liquid if neither of the first and second comparison results indicates the presence of the phase separation. The method may further comprise indicating the presence of mud solids or a measurement error if the first comparison result indicates the presence of the phase separation and the second comparison result indicates the absence of the phase separation. The method may further comprise indicating a measurement error if the first comparison result indicates the absence of the liquid and the second comparison result indicates the presence of the liquid. The measurement error may be associated with at least one of the reference values being in error. The method may further comprise using at least one of the resonant frequency of the MEMS sensor, a fluorescence or a reflectance to indicate the presence or the absence of the liquid.

Detecting the solid separating from the liquid may comprise measuring the temporal pattern of the optical scattering characteristic or the backscattering characteristic and indicating the presence of the solid if each of the first and second comparison results indicates the presence of the phase separation. The method may further comprise indicating the absence of the solid if neither of the first and second comparison results indicates the presence of the phase separation. The method may further comprise indicating the presence of gas bubbles or mud solids if the first comparison result indicates the presence of the phase separation and the second comparison result indicates the absence of the phase separation.

Obtaining the sample may comprise extracting the sample via downhole tool from the subterranean formation. The downhole tool may be a wireline tool or a while-drilling tool (e.g., LWD or MWD), among others.

Each of the first and second reference values may be a relative reference value or an absolute reference value. The relative reference value may be obtained based on a calibration of the sample of the fluid. The method may further comprise changing a pressure of the sample to perform the calibration of the sample. The method may further comprise determining the sample is substantially single phase in response to determining that a characteristic of the sample remains substantially constant while changing the pressure. Changing the pressure may comprise increasing the pressure of the sample. The absolute reference value may be obtained based on a calibration of a standard.

The present disclosure also introduces a method comprising measuring a plurality of characteristics of a fluid to obtain characteristic values, comparing the plurality of characteristic values to corresponding references values, each of which is associated with a substantially single-phase condition of the fluid, and detecting the phase separation condition of the fluid based on the comparisons. The method may further comprise obtaining the reference values via a sample of the fluid or a standard. Detecting the phase separation condition may comprise one of detecting a gas separating from a liquid, a liquid separating from a gas, or a solid separating from a liquid. Detecting the phase separation condition may comprise identifying the presence or the absence of the phase separation condition if the comparisons are consistent with each other or identifying an error or an ambiguous result if the comparisons are inconsistent with each other. The method may further comprise using at least one of the comparisons to resolve the error or the ambiguous result. The method may further comprise obtaining the sample via a wireline tool or a while-drilling tool (e.g., LWD or MWD), among others, and/or performing any of the method steps within the tool.

The present disclosure also introduces a method comprising obtaining a sample of a fluid, measuring a composition of the sample at a plurality of pressures, and detecting the phase separation condition of the fluid based on the variability of the composition for the plurality of pressures. Measuring the composition of the sample at the plurality of pressures may comprise measuring a plurality of optical density values at each of the pressures. The method may further comprise identifying at least one incorrect optical density value in response to detecting that the phase separation condition corresponds to a substantially single-phase condition. Identifying the at least one incorrect optical density value may comprise identifying an optical density value that remains substantially constant for the plurality of pressures or an optical density value that does not change proportionally with other ones of the optical density values for the plurality of pressures. The method may further comprise obtaining the sample via a wireline tool or a while-drilling tool (e.g., LWD or MWD), among others, and/or performing any of the method steps within the tool.

The present disclosure also introduces a method comprising obtaining a sample of a fluid in a fluid analyzer, measuring a composition of the sample at a plurality of times, and identifying an inaccurate optical density measurement based on the variability of the composition for the plurality of times. Identifying the inaccurate optical density measurement based on the variability of the composition for the plurality of times may comprise indentifying an optical density measurement corresponding to an optical density channel of the downhole fluid analyzer providing optical density values that do not vary in proportion to optical density values obtained from at least one other optical density channel of the downhole fluid analyzer. The optical density channel may correspond to carbon dioxide or a hydrocarbon. The optical density channel of the downhole fluid analyzer may provide optical density values that do not substantially vary for the plurality of times. The method may further comprise determining the composition of the sample without including the inaccurate optical density measurement. Measuring the composition of the sample at the plurality of times may comprise measuring the composition of the sample at a plurality of pressures greater than or equal to a pressure at which the sample is substantially single phase. Measuring the composition of the sample at the plurality of times may comprise measuring the composition of the sample at times corresponding to different levels of contamination in the sample. The the inaccurate optical density measurement may be associated with an optical density channel of the fluid analyzer that provides a substantially constant output for the different levels of contamination. The contamination in the sample may be filtrate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method of detecting a phase separation condition of a fluid from a subterranean formation, comprising:

obtaining a sample of the fluid in a downhole tool, the tool including a first sensor configured to measure a first physical property of the fluid and a second sensor configured to measure a second physical property of the fluid;

measuring a first physical property value of the sample using the first sensor;

measuring a second physical property value of the sample using the second sensor;

comparing the first physical property value to a first reference value associated with a single-phase condition of the fluid to generate a corresponding first comparison result;

comparing the second physical property characteristic value to a second reference value associated with the single-phase condition of the fluid to generate a corresponding second comparison result; and detecting the phase separation condition of the fluid based on the first and second comparison results.

2. The method of claim 1 wherein detecting the phase separation condition of the fluid comprises:

detecting a phase separation of the fluid if each of the first and second comparison results indicates the presence of the phase separation;

detecting substantially no phase separation of the fluid if neither of the first and second comparison results indicates the presence of the phase separation; and detecting an ambiguous phase separation result if one of the first and second comparison results indicates the presence of the phase separation and the other one of the first and second comparison results indicates the absence of the phase separation condition.

3. The method of claim 2, wherein the tool further comprises a third sensor configured to measure a third physical property of the fluid, the method further comprising:

measuring a third physical property value of the sample using the third sensor;

comparing the third physical property value to a third reference value associated with the single-phase condition of the fluid to generate a third comparison result; and using the third comparison result to detect the phase separation condition of the fluid if the first and second comparison results provide the ambiguous phase separation result.

4. The method of claim 2 wherein the presence of the phase separation is indicated by any one of the comparison results when the physical property value corresponding to that comparison result is substantially different than the reference value corresponding to that comparison result.

5. The method of claim 2 wherein the absence of the phase separation is indicated by any one of the comparison results when the physical property value corresponding to that comparison result is substantially the same as the reference value corresponding to that comparison result.

6. The method of claim 1 wherein measuring the first physical property value comprises measuring an optical scattering characteristic of the sample wherein measuring the second physical property value comprises measuring one of an acoustic impedance, a resonant frequency of a micro electro-mechanical systems (MEMS) sensor, a temporal characteristic of the optical scattering characteristic, or a backscattering characteristic, and wherein detecting the phase separation condition of the fluid comprises detecting a gas separating from a liquid, a liquid separating from a gas, or a solid separating from a liquid.

7. The method of claim 6 wherein detecting the gas separating from the liquid comprises measuring the acoustic impedance and indicating the presence of the gas if the each of the first and second comparison results indicates the presence of the phase separation.

8. The method of claim 7 further comprising measuring a reflectance value of the sample and indicating a relative amount of the gas based on the reflectance value.

9. The method of claim 7 further comprising indicating the absence of the gas if neither of the first and second comparison results indicates the presence of the phase separation.

10. The method of claim 7 further comprising indicating the presence of mud solids if the first comparison result indicates the presence of the phase separation and the second comparison result indicates the absence of the phase separation.

11. The method of claim 10 further comprising using at least one of the resonant frequency of the MEMS sensor or the temporal characteristic of the optical scattering characteristic to indicate the presence of the mud solids or the absence of the gas.

12. The method of claim 7 further comprising indicating a measurement error if the first comparison result indicates the absence of the gas and the second comparison result indicates the presence of the gas.

13. The method of claim 12 wherein the measurement error is associated with at least one of the reference values being in error.

14. The method of claim 13 further comprising using the resonant frequency of the MEMS sensor to indicate the presence or the absence of the gas.

15. The method of claim 6 wherein detecting the liquid separating from the gas comprises measuring the resonant frequency of the MEMS sensor and indicating the presence of the liquid if each of the first and second comparison results indicates the presence of the phase separation.

16. The method of claim 15 further comprising measuring a fluorescence value of the sample and indicating a relative amount of the liquid based on the fluorescence value.

17. The method of claim 15 further comprising indicating the absence of the liquid if neither of the first and second comparison results indicates the presence of the phase separation.

18. The method of claim 15 further comprising indicating the presence of mud solids or a measurement error if the first comparison result indicates the presence of the phase separation and the second comparison result indicates the absence of the phase separation.

19. The method of claim 15 further comprising indicating a measurement error if the first comparison result indicates the absence of the liquid and the second comparison result indicates the presence of the liquid.

20. The method of claim 19 wherein the measurement error is associated with at least one of the reference values being in error.

21. The method of claim 19 further comprising using at least one of the resonant frequency of the MEMS sensor, a fluorescence or a reflectance to indicate the presence or the absence of the liquid.

22. The method of claim 6 wherein detecting the solid separating from the liquid comprises measuring the temporal pattern of the optical scattering characteristic or the backscattering characteristic and indicating the presence of the solid if each of the first and second comparison results indicates the presence of the phase separation.

23. The method of claim 22 further comprising indicating the absence of the solid if neither of the first and second comparison results indicates the presence of the phase separation.

24. The method of claim 22 further comprising indicating the presence of gas bubbles or mud solids if the first comparison result indicates the presence of the phase separation and the second comparison result indicates the absence of the phase separation.

25. The method of claim 1 wherein obtaining the sample comprises extracting the sample via downhole tool from the subterranean formation, wherein the downhole tool is or comprises a wireline tool, a measurement-while-drilling (MWD) tool, or a logging-while-drilling (LWD) tool.

26. The method of claim 1 further comprising obtaining the reference values via a sample of the fluid or a standard.

* * * * *